US008614045B2

(12) United States Patent
Numakura et al.

(10) Patent No.: US 8,614,045 B2
(45) Date of Patent: Dec. 24, 2013

(54) LIQUID DEVELOPER AND METHOD FOR PRODUCING LIQUID DEVELOPER

(75) Inventors: Kenichi Numakura, Nagano (JP); Yoshihiro Ueno, Nagano (JP); Masahiro Oki, Saitama (JP); Tsutomu Teraoka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 104 days.

(21) Appl. No.: 13/302,408

(22) Filed: Nov. 22, 2011

(65) Prior Publication Data

US 2012/0301820 A1 Nov. 29, 2012

(30) Foreign Application Priority Data

Nov. 24, 2010 (JP) ..... 2010-261365
Feb. 28, 2011 (JP) ..... 2011-042881
Apr. 5, 2011 (JP) ..... 2011-083747

(51) Int. Cl.
*G03G 9/08* (2006.01)

(52) U.S. Cl.
USPC ..... 430/115; 430/116; 430/137.22

(58) Field of Classification Search
USPC ..... 430/115, 116, 137.22
See application file for complete search history.

(56) References Cited

U.S. PATENT DOCUMENTS

| | | | | |
|---|---|---|---|---|
| 4,833,225 | A | 5/1989 | Schaefer et al. | |
| 4,891,166 | A | 1/1990 | Schaefer et al. | |
| 5,637,295 | A | 6/1997 | Lang et al. | |
| 2003/0143477 | A1 * | 7/2003 | Fukuda et al. | 430/115 |

FOREIGN PATENT DOCUMENTS

| | | | |
|---|---|---|---|
| DE | 3705121 | A1 | 9/1988 |
| DE | 3719086 | C1 | 10/1988 |
| EP | 0530974 | A1 | 3/1993 |
| EP | 0617607 | A1 | 10/1994 |
| EP | 0714654 | A1 | 6/1996 |
| JP | 2003-508826 | A | 3/2003 |
| JP | 2007-219380 | A | 8/2007 |
| WO | WO-94/08556 | A1 | 4/1994 |
| WO | WO-01/18608 | A1 | 3/2001 |

* cited by examiner

*Primary Examiner* — Mark A Chapman
(74) *Attorney, Agent, or Firm* — Global IP Counselors, LLP

(57) ABSTRACT

A liquid developer is provided. The liquid developer includes a liquid insulator and toner particles. The liquid insulator toner particles include a resin material, a colorant, a substance A, a substance B, and a substance C. The substance A is an acrylic-modified silicone. The substance B is at least one selected from the group consisting a quaternary cationic silicone, an aminophenyl-modified silicone, and a phenyl-modified silicone. The substance C is at least one of a silanol-containing polysiloxane and a fluorine-modified silicone. The average degree of roundness $R_1$ of the toner particles is 0.890 or greater, if the degree of roundness is expressed as $L_0/L_1$, where $L_1$ (μm) is a circumference of a profile view of a measured particle and $L_0$ (μm) is the circumference of a perfect circle of a circumference of a profile view corresponding to the profile view of the measured particle.

16 Claims, 2 Drawing Sheets

LIQUID DEVELOPER AND METHOD FOR PRODUCING LIQUID DEVELOPER

CROSS-REFERENCE TO RELATED APPLICATIONS

This application claims priority to Japanese Patent Application Nos. 2010-2010-261365 filed on Nov. 24, 2010, 2011-042881 filed on Feb. 28, 2011, and 2011-083747, filed on Apr. 5, 2011. The entire disclosure of Japanese Patent Application Nos. 2010-261365, 2011-042881 and 2011-083747 is hereby incorporated herein by reference.

BACKGROUND

1. Technological Field

The present invention relates to a liquid developer and to a method for producing a liquid developer.

2. Background Technology

A liquid developer in which a toner including a material which includes a pigment or other colorant and a binder resin is dispersed in an electrically insulative carrier liquid (liquid insulator) is known as a developer used for developing an electrostatic latent image formed on a latent image carrier. Polyester resin, styrene-acrylic acid ester copolymer, epoxy resin, and other resin materials have been used in the past in the toner particles that constitute a liquid developer such as described above (see Patent Citation 1, for example). Such a resin material has the characteristics of easy handling, good color density of the resultant image, and high fixation characteristics. However, since the resin material used as the constituent material of the toner particles as such is usually negatively chargeable, the material is difficult to adapt to positively chargeable toner particles (liquid developer). Although the toner particles in which such a resin material is used can be positively charged by adding a charge control agent, an adequate amount of charge is difficult to obtain.

Japanese Laid-open Patent Publication No. 2007-219380 (Patent Citation 1) is an example of the related art.

SUMMARY

Problems to be Solved by the Invention

An advantage of the invention is to provide a liquid developer having excellent positive charging characteristics, and to provide a method for producing a liquid developer whereby a liquid developer such as described above can be efficiently manufactured.

Means Used to Solve the Above-Mentioned Problems

A liquid developer is provided. The liquid developer includes a liquid insulator and toner particles. The liquid insulator toner particles include a resin material, a colorant, a substance A, a substance B, and a substance C. The substance A is an acrylic-modified silicone. The substance B is at least one selected from the group consisting a quaternary cationic silicone, an aminophenyl-modified silicone, and a phenyl-modified silicone. The substance C is at least one of a silanol-containing polysiloxane and a fluorine-modified silicone. The average degree of degree of roundness $R_1$ of the toner particles is 0.890 or greater, if the degree of roundness is expressed as $L_0/L_1$, where $L_1$ (μm) is a circumference of a profile view of a measured particle and $L_0$ (μm) is the circumference of a perfect circle of a circumference of a profile view corresponding to the profile view of the measured particle.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
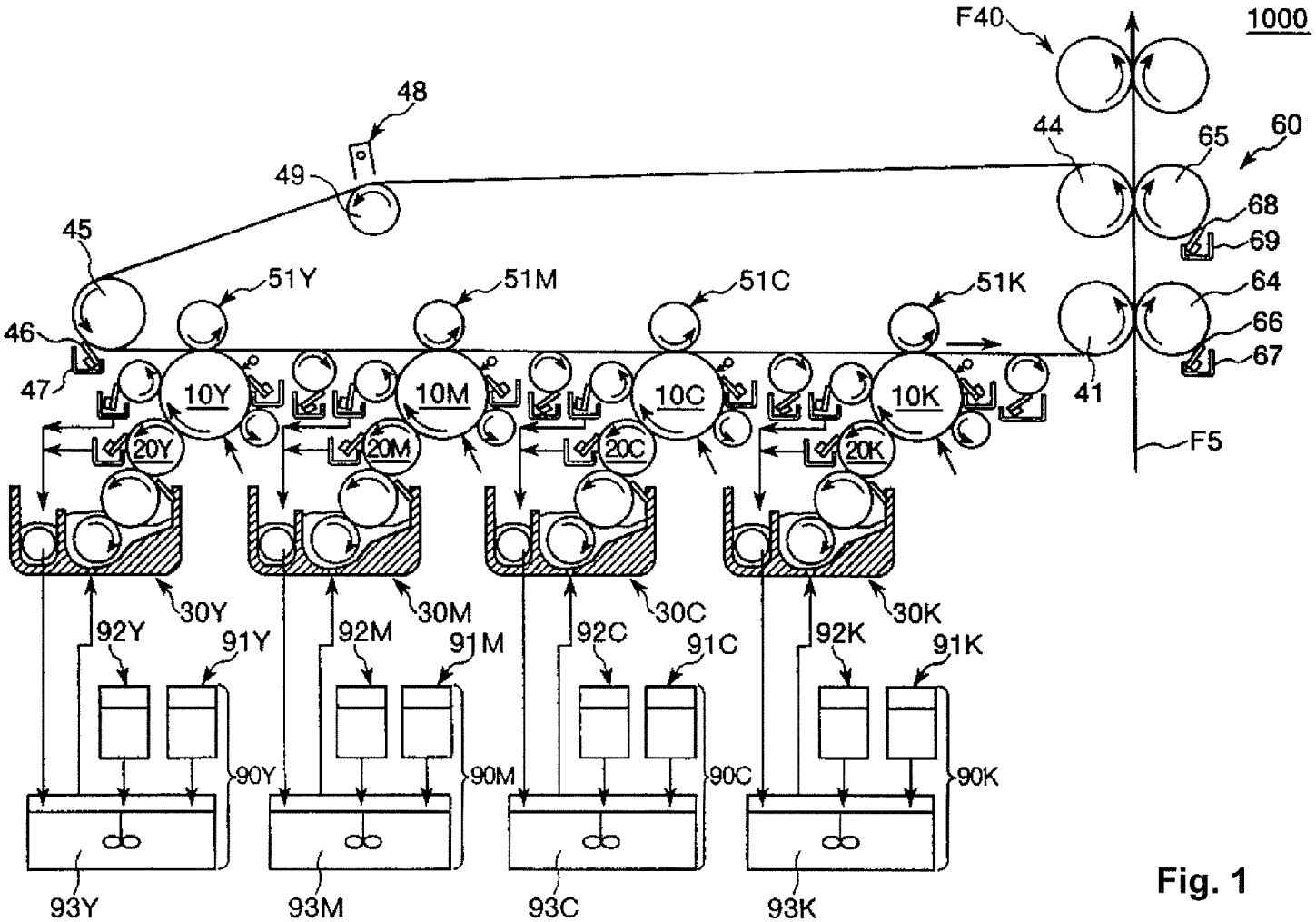
FIG. 1 is a schematic view showing an example of an image formation device in which the liquid developer of the invention is applied.

Preferred embodiments of the invention are described in detail below.

Method for Producing a Liquid Developer

The method for producing a liquid developer of the invention will first be described. In the invention, the liquid developer is one in which toner particles are dispersed in a liquid insulator.

First Embodiment

The method for producing a liquid developer of the present embodiment has a wet pulverization step of obtaining a dispersion in a liquid insulator by wet-pulverizing a powder composed of a material which includes a resin material and a colorant, in the presence of an acrylic-modified silicone as a substance A, and a substance B which is at least one species selected from the group including a quaternary cationic silicone, an aminophenyl-modified silicone, and a phenyl-modified silicone; a heating step of heat-treating the dispersion at a temperature higher than the glass transition temperature of the resin material; and a mixing step of mixing the heat-treated dispersion and a silanol-containing polysiloxane and/or a fluorine-modified silicone as a substance C.

However, since the resin material used as the constituent material of the toner particles as such is usually negatively chargeable, the material is difficult to adapt to positively chargeable toner particles (liquid developer). Although the toner particles in which such a resin material is used can be positively charged by adding a charge control agent, an adequate amount of charge is difficult to obtain. In the present embodiment, however, substance A and substance B are used in the wet pulverization step, substance C is used in the mixing step, and a heating step is provided between the wet pulverization step and the mixing step, as described above, and substance A, substance B, and substance C can thereby be suitably affixed near the surfaces of the toner particles in a predetermined arrangement, and the liquid developer can be endowed with excellent positive charging characteristics.

Each step is described in detail below.

Wet Pulverization Step

First, a dispersion in a liquid insulator is obtained by wet-pulverizing a powder composed of a material which includes a resin material and a colorant, in the presence of an acrylic-modified silicone as substance A, and substance B which is at least one species selected from the group including a quaternary cationic silicone, an aminophenyl-modified silicone, and a phenyl-modified silicone.

In this step, the wet-pulverized powder can be composed of a material which includes a resin material and a colorant, but the wet-pulverized powder is preferably obtained by pulverizing a kneaded product obtained by kneading a material which includes a resin material and a colorant. Particularly excellent uniformity of characteristics between toner particles can thereby be obtained. Various types of kneading machines can be used for kneading, such as a twin-screw kneading extruder, a kneader, a batch-type three-screw roller, a continuous twin-screw roller, a wheel mixer, a blade mixer, or the like. In the invention, the resin material is not particularly limited, and a publicly known resin, for example, can be used.

Resin Material

A material which includes polyester resin is particularly preferred for use as the resin material. Polyester resin has high transparency, and when used as a binder resin, high color density can be obtained in the resultant image. Polyester resin is therefore suitable for use as the resin material. In the case that the resin material includes polyester resin, the acid value of the polyester resin is preferably 5 mg KOH/g or greater and 20 mg KOH/g or less, and more preferably 5 mg KOH/g or greater and 15 mg KOH/g or less.

The content ratio of the polyester resin in the resin material is preferably 50% by mass or greater and 99% by mass or less, and more preferably 60% by mass or greater and 95% by mass or less. The resin material preferably includes polyester resin as well as a rosin-based resin. Substance A, substance B, and substance C can thereby be suitably affixed near the surfaces of the toner particles in a predetermined arrangement, the toner particles can be endowed with particularly excellent charging characteristics and fixing characteristics on a recording medium, and the liquid developer can be endowed with particularly excellent storage stability and other characteristics.

Examples of rosin-based resins include rosin-modified phenol resin, rosin-modified maleic resin, rosin-modified polyester resin, fumaric acid-modified rosin resin, ester gum, and the like, and these can be used singly or in combinations of two or more types thereof. The weight-average molecular weight of the rosin-based resin is preferably 500 or greater and 100,000 or less, more preferably 1,000 or greater and 80,000 or less, and more preferably 1,000 or greater and 50,000 or less. Higher levels of fixing characteristics and heat-resistant storage stability of the toner particles can thereby be achieved at the same time.

The acid value of the rosin-based resin is preferably 40 mg KOH/g or less, more preferably 30 mg KOH/g or less, and more preferably 5 mg KOH/g or greater and 25 mg KOH/g or less. Higher levels of fixing characteristics and heat-resistant storage stability of the toner particles can thereby be achieved at the same time. The content ratio of the rosin-based resin in the resin material that constitutes the toner particles is preferably 1% by mass or greater and 50% by mass or less, and more preferably 5% by mass or greater and 40% by mass or less. Higher levels of fixing characteristics and heat-resistant storage stability of the toner particles can thereby be achieved at the same time.

The glass transition temperature (™) of the resin material used in the invention is preferably 15° C. or higher and 70° C. or lower, and more preferably 20° C. or higher and 55° C. or lower. In the present specification, "glass transition temperature" is the temperature where the extension of a base line equal to or lower than the glass transition temperature intersects with the tangent line that indicates the maximum slope from the rising portion of the peak to the top of the peak in a measurement using a sample weight of 10 mg, a temperature increase rate of 10° C./min, and a measured temperature range of 10 to 150° C. in a DSC-220C differential scanning calorimeter (manufactured by SII).

The softening point (T1/2) of the resin material is also not particularly limited, and is preferably 50° C. or higher and 130° C. or lower, more preferably 50° C. or higher and 120° C. or lower, and more preferably 60° C. or higher and 115° C. or lower. In the present specification, the softening temperature is the temperature at which softening begins under measurement conditions of a temperature increase rate of 5° C./min and a die hole diameter of 1.0 mm in a Koka flow tester (manufactured by Shimadzu Seisakusho).

Colorant

The colorant used in the invention is not particularly limited, and a publicly known pigment, dye, or the like, for example can be used.

Liquid Insulator

Wet pulverization in the present step is performed in a liquid insulator. The liquid insulator functions as a dispersion medium for dispersing the toner particles in the liquid developer ultimately obtained. The liquid insulator is highly insulative so as to cause the charged toner particles to be transferred during image formation. The liquid insulator can be any liquid that is insulative to an adequately high degree, but the liquid insulator specifically has an electrical resistance at room temperature (20° C.) of preferably $1\times10^{9}$ Ωcm or greater, more preferably $1\times10^{11}$ Ωcm or greater, and more preferably $1\times10^{13}$ Ωcm or greater. The relative permittivity of the liquid insulator is preferably 3.5 or less.

Examples of liquid insulators include KF-99, KF-96, and KF-995 (all manufactured by Shin-Etsu Chemical Co., Ltd.), AK35, AK50, AK100, AK350, and AK1000 (all manufactured by Wacker Chemie AG), SH200, SH510, and SH8400 (all manufactured by Toray Dow Corning), and other dimethyl silicone oils; hydrogen-modified silicone compounds and other silicone oils having a degree of polymerization greater than 20; cyclopentane siloxane, decamethyl cyclopentane siloxane, and other cyclic siloxane compounds or methyltris(trimethylsiloxy)silane and other low-molecular-weight siloxane compounds having a degree of polymerization of 20 or less; Isopar E, Isopar G, Isopar H, and Isopar L (Isopar; trade name of Exxon Chemical), Shellsol 70 and Shellsol 71 (Shellsol; trade name of Shell Oil), Amsco OMS and Amsco 460 solvents (Amsco; trade name of American Mineral Spirits Company), low-viscosity/high-viscosity liquid paraffin (Wako Pure Chemical Industries, Ltd.) and other mineral oils (hydrocarbon-based liquids); fatty acid glycerides, fatty acid monoesters, medium-chain fatty acid esters, and other fatty acid esters or vegetable oils containing the same; and octane, isooctane, decane, isodecane, decalin, nonane, dodecane, isodecane, cyclohexane, cyclooctane, cyclodecane, benzene, toluene, xylene, mesitylene, butyl acetate, isopropanol, and the like, and these can be used singly or in combinations of two or more types thereof. In the present step, among the liquid insulators described above, dimethyl silicone oil is preferably used as the liquid insulator. The liquid developer can thereby be obtained with particularly excellent productivity, and the toner particles can be endowed with particularly excellent dispersion stability in the liquid developer.

As described above, wet pulverization is performed in the presence of substance A and substance B in the present step. Substance A and substance B are described in detail below.

Substance A

In the present step, an acrylic-modified silicone is used as substance A. In particular, an acrylic-modified silicone is used as substance A together with substance B described in detail hereinafter. Substance A and substance B can thereby be suitably affixed near the surfaces of the particles, and in a subsequent step, substance C can be suitably affixed to the toner particles, and the toner particles can be adequately endowed with excellent positive charging characteristics.

Excellent dispersion stability of the toner particles in the liquid developer ultimately obtained, and excellent storage stability of the liquid developer can also be obtained. Substance A also has the function of preventing aggregation of particles during manufacturing of the liquid developer.

An (acrylates/polytrimethylsiloxy methacrylate) copolymer, for example, or the like can be used as the acrylic-modified silicone of substance A. Specifically, the monomer component constituting the acrylic-based polymer is not particularly limited, and examples thereof include acrylic acid, methacrylic acid, acrylic acid alkyl esters, methacrylic acid alkyl esters, and other acrylic acid or methacrylic acid derivatives, and these can be used singly or in combinations of two or more types thereof. Examples of acrylic-based polymers composed of the monomer components described above include polymers with one or more types of monomers selected from acrylic acid, methacrylic acid, and alkyl esters thereof, where the alkyl groups of the monomers (acrylates) have a carbon number of 4 or less. The acrylic-modified silicone can also be with a plurality of types of acrylic-based polymers. The acrylic-based polymers constituting the acrylic-modified silicone are preferably acrylates and acrylic acid alkyl esters, and acrylates and ethylhexyl acrylate are more preferred. The effects of the acrylic-modified silicone described above can thereby be more significantly obtained, and the toner particles can be endowed with particularly excellent dispersion stability in the liquid developer. The acrylic-based polymer can also be composed of monomer components other than those described above. The polysiloxane constituting the acrylic-modified silicone is also not particularly limited, examples thereof include dimethylpolysiloxane and other dialkyl polysiloxanes, and diphenylpolysiloxane and other diaryl polysiloxanes, and these can be used singly or in combinations of two or more types thereof. Among the above examples, dialkyl siloxane is preferably included, and dimethylpolysiloxane is more preferably included as the polysiloxane. The effects of the acrylic-modified silicone such as described above can thereby be more significantly obtained, and the toner particles can be endowed with particularly excellent dispersion stability in the liquid developer. A side chain or terminal end of the polysiloxane constituting the acrylic-modified silicone can also be substituted with another functional group or the like. For example, acrylic acid and methacrylic acid can be added to a side chain or terminal end of the polysiloxane. In this case, the toner particles can be endowed with particularly excellent dispersion stability in the liquid developer. The polysiloxane described above can be straight-chain or branched. The acrylic-based silicone is obtained by graft polymerization of an acrylic-based polymer and a polysiloxane. This process causes the acrylic-modified silicone to have numerous branched chains and to be bulky. As a result, the portion having relatively large polarity (acrylic-based polymer portion) and the portion having relatively small polarity (polysiloxane portion) can adequately demonstrate the functions thereof.

The use of an (acrylates/polytrimethylsiloxy methacrylate) copolymer as substance A enables the toner particles to be endowed with particularly excellent positive charging characteristics, and excellent dispersion stability of the toner particles in the liquid developer ultimately obtained, and excellent storage stability of the liquid developer can also be obtained. Since aggregation of particles can be more effectively prevented during manufacturing (particularly in the heating step described in detail hereinafter) of the liquid developer, the liquid developer can be obtained with particularly excellent productivity, for example. Specific examples of acrylic-modified silicones that can be used as substance A include FA40021D (manufactured by Toray Dow Corning), KP545 (manufactured by Shin-Etsu Chemical Co., Ltd.), and the like.

In the present step, the used amount of substance A is preferably such that the content ratio thereof in the liquid developer ultimately obtained is 0.5% by mass or greater and 10.0% by mass or less, and more preferably 1.0% by mass or greater and 7.0% by mass or less. Particularly excellent dispersion stability of the toner particles in the liquid developer can thereby be obtained while the toner particles are endowed with particularly excellent charging characteristics. The liquid developer can also be endowed with particularly excellent development and transfer characteristics.

Substance B

In the present step, at least one species selected from the group including a quaternary cationic silicone, an aminophenyl-modified silicone, and a phenyl-modified silicone is used as substance B. In particular, substance B is used together with substance A described above. Substance A and substance B can thereby be suitably affixed near the surfaces of the particles, and in a subsequent step, substance C can be suitably affixed to the toner particles, and the toner particles can be adequately endowed with excellent positive charging characteristics. Excellent dispersion stability of the toner particles in the liquid developer ultimately obtained, and excellent storage stability of the liquid developer can also be obtained. In particular, the use of substance B enables the particles to be endowed with high chargeability.

A quaternary cationic silicone is a silicone that has a quaternary ammonium group, and a "silicone that has a quaternary ammonium group" is termed to mean any silicone that has one or more quaternary ammonium groups. These quaternary ammonium groups can be bonded in alpha or omega positions in the form of lateral groups, and can be directly bonded to a polysiloxane backbone or supported by a hydrocarbon base chain.

In the invention, the term "silicone" is generally allowed as meaning any polymer having a structure based on bonding between silicon and oxygen atoms by a bond known as a siloxane bond (—Si—O—Si—), further characterized by the presence of a silicon-carbon bond. Such silicones or polysiloxanes are generally obtained by polycondensation of appropriately functionalized silanes. The hydrocarbon base groups most often supported by a silicon atom are lower alkyl groups, particularly methyl, and fluoroalkyl and aryl groups, particularly phenyl. Such silicones are marketed under the names ABIL Quat 3272, ABIL B9905, ABIL Quat 3474, and ABIL K3270 from Goldschmidt; Silquat Q-100, Silquat Q-200WS, Silquat AX, Silquat AC, Silquat AD, and Silquat AM (all manufactured by Siltech) from Lipo France; and Magnasoft Exhaust and Silsoft C-880 from OSI; Pecosil 14-PQ and Pecosil 36-PQ (manufactured by Phoenix Chemical) from UCIB, for example.

These silicones are described in particular in European Patent No. 530974, German Patent No. 3719086, German Patent No. 3705121, European Patent No. 617607, and European Patent No. 714654. Among silicones, SilSense Q-Plus (manufactured by Lubrizol Corporation) is particularly preferred. The use of SilSense Q-Plus (manufactured by Lubrizol Corporation) as substance B enables the toner particles to be endowed with particularly excellent positive charging characteristics, and excellent dispersion stability of the toner particles in the liquid developer ultimately obtained, and excellent storage stability of the liquid developer can also be obtained.

Examples of aminophenyl-modified silicones as substance B include aminopropyl phenyl trimethycone and the like. The use of aminopropyl phenyl trimethycone as substance B enables the toner particles to be endowed with particularly excellent positive charging characteristics, and excellent dispersion stability of the toner particles in the liquid developer ultimately obtained, and excellent storage stability of the liquid developer can also be obtained.

Specific examples of aminophenyl-modified silicones that can be used as substance B include 2-2078 Fluid (manufactured by Toray Dow Corning) and the like. Examples of phenyl-modified silicones as substance B include phenyl siloxy silicate resin, trimethyl pentaphenyl trisiloxane, and the like. The use of phenyl siloxy silicate resin and trimethyl pentaphenyl trisiloxane as substance B enables the toner particles to be endowed with particularly excellent positive charging characteristics, and excellent dispersion stability of the toner particles in the liquid developer ultimately obtained, and excellent storage stability of the liquid developer can also be obtained. Specific examples of phenyl-modified silicones that can be used as substance B include SH556 (manufactured by Toray Dow Corning), PH1555 (manufactured by Toray Dow Corning), Silshine 151 (manufactured by Momentive), and the like.

As described above, at least one species selected from the group including a quaternary cationic silicone, an aminophenyl-modified silicone, and a phenyl-modified silicone can be used as substance B, but a quaternary cationic silicone and/or an aminophenyl-modified silicone is preferably used, and an aminophenyl-modified silicone is more preferably used. It is thereby possible for the toner particles to be endowed with particularly excellent positive charging characteristics, and excellent dispersion stability of the toner particles in the liquid developer ultimately obtained, and excellent storage stability of the liquid developer can also be obtained.

In the present step, the used amount of substance B is preferably such that the content ratio thereof in the liquid developer ultimately obtained is 0.02% by mass or greater and 4.0% by mass or less, and more preferably 0.05% by mass or greater and 1.0% by mass or less. Particularly excellent dispersion stability of the toner particles in the liquid developer can thereby be obtained while the toner particles are endowed with particularly excellent charging characteristics. The liquid developer can also be endowed with particularly excellent development and transfer characteristics. The present step can be performed by using a ball mill, a vibrating mill, a jet mill, a pin mill, or various other pulverizing devices or grinding devices, but use of a ball mill is preferred. The toner particles can thereby be endowed with particularly excellent positive charging characteristics. Particularly excellent dispersion stability of the toner particles in the liquid developer can also be obtained.

If the roundness of a measured particle is expressed as $L_0/L_1$, where $L_1$ (μm) is the circumference of a profile view of the measured particle and $L_0$ (μm) is the circumference of a perfect circle of equal area to the profile view of the measured particle, the present step is preferably performed so that the average roundness $R_1$ of the particles included in the dispersion (dispersion prior to the heat treatment described hereinafter) obtained by the present step satisfies the following relationship: $0.800 \leq R_0 \leq 0.889$. Particularly excellent uniformity of charging characteristics between toner particles can thereby be obtained, and the liquid developer can be endowed with particularly excellent storage stability, transfer efficiency, and other characteristics.

Heating Step

The dispersion obtained via the wet pulverization step is then heat-treated. In particular, heat treatment is performed at a temperature higher than the glass transition temperature of the resin material. Substance A and substance B can thereby be reliably affixed near the surfaces of the particles, and the roundness of the particles can be adjusted to the appropriate level. As a result, the toner particles constituting the liquid developer ultimately obtained can be endowed with excellent positive charging characteristics, and the toner particles can be endowed with excellent dispersion stability in the liquid developer. The toner particles can also be endowed with excellent transfer efficiency, development efficiency, and other characteristics.

The treatment temperature in the present step is preferably Tg [° C.] or higher and (Tg+30) [° C.] or lower, more preferably Tg [° C.] or higher and Tg+20 [° C.] or lower, and more preferably Tg+5 [° C.] or higher and Tg+10 [° C.] or lower, where Tg [° C.] is the glass transition temperature of the resin material. Such effects as those described above are thereby more significantly demonstrated, and the liquid developer can be obtained with particularly excellent productivity. If the resin material constituting the coarse pulverized product is composed of a plurality of types of components (resin components), the glass transition temperature of the mixture as a whole is used as Tg.

The heat treatment time in the present step is preferably 5 minutes or greater and 150 minutes or less, and more preferably 10 minutes or greater and 90 minutes or less. Such effects as those described above are thereby more significantly demonstrated, and the liquid developer can be obtained with particularly excellent productivity. The present step is also performed by heating while applying a shearing force to the dispersion. The toner particles can thereby be endowed with particularly excellent charging characteristics, and the liquid developer can be endowed with particularly excellent storage stability, transfer efficiency, and other characteristics. In the case that the present step is performed while applying a shear, the shear is preferably 300 rpm or greater and 1200 or less, and more preferably 400 rpm or greater and 900 rpm or less.

If the roundness of a measured particle is expressed as $L_0/L_1$, where $L_1$ (μm) is the circumference of a profile view of the measured particle and $L_0$ (μm) is the circumference of a perfect circle of equal area to the profile view of the measured particle, the present step is preferably performed so that $R_1$ is 0.890 or greater, where $R_1$ is the average roundness of the particles included in the dispersion after the present step (after heat treatment), and so that the average roundness $R_0$ of the particles included in the dispersion prior to the present step (prior to heat treatment) and the average roundness $R_1$ satisfy the following relationship: $0.01 \leq R_1 - R_0 \leq 0.10$. Particularly excellent uniformity of charging characteristics between toner particles can thereby be obtained, and the liquid developer can be endowed with particularly excellent storage stability, transfer efficiency, and other characteristics.

As described above, $R_1$ can be 0.890 or greater, preferably 0.895 or greater and 0.970 or less, and more preferably 0.900 or greater and 0.960 or less. Such effects as those described above are thereby more significantly demonstrated. The relationship $0.01 \leq R_1 - R_0 \leq 0.10$ is preferably satisfied, but the relationship $0.02 \leq R_1 - R_0 \leq 0.09$ is more preferably satisfied, and the relationship $0.03 \leq R_1 - R_0 \leq 0.08$ is more preferably satisfied. Such effects as those described above are thereby more significantly demonstrated.

The roundness of the particles is measured using an FPIA-3000, FPIA-3000S (each manufactured by Sysmex), or other flow particle image analyzer, for example. Such a device employs a scheme for measuring particles dispersed in a dispersion medium by flow image analysis, in which a suctioned particle suspension is introduced to a flat sheath flow cell and a flat sample flow is formed by a sheath liquid. The sample flow is irradiated by a strobe light, and an image of the particles is captured using a CCD camera. The roundness described above is computed using the circumference obtained from an image of the particles which is subjected to two-dimensional image processing.

Mixing Step

The heat-treated dispersion and the silanol-containing polysiloxane and/or fluorine-modified silicone as substance C are then mixed together.

[Substance C]

In the present step, a silanol-containing polysiloxane and/or fluorine-modified silicone is used as substance C. Substance C can thereby be suitably affixed near the surfaces of the particles to which substance A and substance B are affixed, and the toner particles can be adequately endowed with excellent positive charging characteristics. Excellent dispersion stability of the toner particles in the liquid developer, and excellent storage stability of the liquid developer can also be obtained. The overall viscosity of the liquid developer can also be reduced. The use of a silanol-containing polysiloxane as substance C enables the particles to be endowed with particularly high chargeability. Since a fluorine-modified silicone alone is usually negatively chargeable, if a fluorine-modified silicone is used as substance C, the advantages of the invention cannot be achieved unless the fluorine-modified silicone is used together with substance A and substance B described above.

Fluorine-Modified Silicone

The fluorine-modified silicone as substance C is described in detail below. A fluorine-modified silicone having an M unit ($R^1R^2R^3SiO_{1/2}$) and a Q unit ($SiO_{4/2}$) can be suitably used as substance C (where $R^1$, $R^2$, and $R^3$ are each independently a monovalent aliphatic hydrocarbon group having a carbon number of 1 or greater and 10 or less or a monovalent aromatic hydrocarbon group having a carbon number of 6 or greater and 15 or less). Particularly excellent dispersion stability of the toner particles in the liquid developer can thereby be obtained while the toner particles are endowed with particularly excellent charging characteristics. The liquid developer can also be endowed with particularly excellent development and transfer characteristics.

Examples of fluorine-modified silicones as substance C include fluoroalkyl dimethyl trimethyl siloxysilicate and the like. The use of fluoroalkyl dimethyl trimethyl siloxysilicate as substance C makes it possible to obtain particularly excellent dispersion stability of the toner particles in the liquid developer, storage stability of the liquid developer, and other characteristics. Specific examples of fluorine-modified silicones that can be used as substance C include X566-B8226 (manufactured by Momentive), XS66-C1191 (manufactured by Momentive), X566-B8636 (manufactured by Momentive), and the like.

Silanol-Containing Polysiloxane

The silanol-containing polysiloxane as substance C is described in detail below. A silanol-containing polysiloxane having an M unit ($R^1R^2R^3SiO_{1/2}$) and a Q unit ($SiO_{4/2}$) can be suitably used as substance C (where $R^1$, $R^2$, and $R^3$ are each independently a monovalent aliphatic hydrocarbon group having a carbon number of 1 or greater and 10 or less or a monovalent aromatic hydrocarbon group having a carbon number of 6 or greater and 15 or less). Particularly excellent dispersion stability of the toner particles in the liquid developer can thereby be obtained while the toner particles are endowed with particularly excellent charging characteristics. The liquid developer can also be endowed with particularly excellent development and transfer characteristics.

Examples of silanol-containing polysiloxanes as substance C include tetra(trimethylsiloxy)silane and the like. The use of tetra(trimethylsiloxy)silane as substance C enables the toner particles to be endowed with particularly excellent positive charging characteristics, and particularly excellent dispersion stability of the toner particles in the liquid developer and storage stability of the liquid developer can be obtained. Specific examples of silanol-containing polysiloxanes that can be used as substance C include DC593 (manufactured by Toray Dow Corning), SS4267 (manufactured by Momentive), SS4230 (manufactured by Momentive), and the like.

In the present step, the used amount of substance C is preferably such that the content ratio thereof in the liquid developer ultimately obtained is 0.02% by mass or greater and 12.5% by mass or less, and more preferably 0.05% by mass or greater and 5.0% by mass or less. Particularly excellent dispersion stability of the toner particles in the liquid developer can thereby be obtained while the toner particles are endowed with particularly excellent charging characteristics. The liquid developer can also be endowed with particularly excellent development and transfer characteristics.

Second Embodiment

A second embodiment of the method for producing a liquid developer of the invention will next be described. The following description will focus on the differences with respect to the first embodiment, and aspects of the second embodiment that are the same as in the first embodiment will not be described. The method for producing a liquid developer of the present embodiment has a wet pulverization step of pulverizing a powder including a material which includes a resin material and a colorant in the presence of the substance A, the substance B, and the substance C to obtain a dispersion in the liquid insulator; and a heating step of heat-treating the dispersion at a temperature higher than the glass transition temperature of the resin material while applying a shearing force to the dispersion. In other words, the method described above is the same as that of the first embodiment except that the wet pulverization step is performed in the presence of substance A, substance B, and substance C, and the mixing step after the heating step is omitted. The same effects as those described above can be obtained in this case as well. Since the mixing step can be omitted, the liquid developer can be obtained with particularly excellent productivity.

Third Embodiment

A third embodiment of the method for producing a liquid developer of the invention will next be described. The method for producing a liquid developer of the present embodiment has a kneading step of kneading a toner material which includes a polyester resin and a colorant; pulverization step of pulverizing the resultant coarse pulverized product in a liquid insulator having a viscosity of 20 cs or greater at 20° C. and in the presence of an acrylic-modified silicone that is essentially insoluble in the liquid insulator, and a solvent in which the acrylic-modified silicone is insoluble, whereas the solvent is soluble in the liquid insulator, to obtain a dispersion in which microparticles are dispersed; and a heating step of heat-treating the dispersion at a temperature higher than the glass transition temperature of the polyester resin.

Since the polyester resin used as the constituent material of the toner particles as such is negatively chargeable, the material is difficult to adapt to positively chargeable toner particles (liquid developer). Such a material is also difficult to pulverize in order to obtain particles of the desired particle diameter. Although the toner particles in which such a resin material is used can be positively charged by adding a charge control agent, an adequate amount of charge is difficult to obtain.

Therefore, by pulverizing a toner material which includes the polyester resin and a colorant in the liquid insulator in the presence of an acrylic-modified silicone that is essentially insoluble in the liquid insulator, and a solvent in which the acrylic-modified silicone is insoluble, whereas the solvent is soluble in the liquid insulator, the toner material can be efficiently pulverized, the acrylic-modified silicone can be affixed to the surfaces of the toner particles ultimately obtained, and liquid developer having excellent positive charging characteristics can easily be manufactured.

Each step is described in detail below.

Mixing Step

In the present step, the polyester resin, a colorant, and other toner materials are kneaded to obtain a kneaded product. Various types of kneading machines can be used for kneading these materials, such as a twin-screw kneading extruder, a kneader, a batch-type three-screw roller, a continuous twin-screw roller, a wheel mixer, a blade mixer, or the like. Each component is described below.

Polyester Resin

Polyester resin has high transparency, and when used as a binder resin, high color density can be obtained in the resultant image. Polyester resin is therefore suitable for use as the resin material. However, this polyester resin is difficult to pulverize, but by applying the invention, the polyester resin can easily be pulverized.

In the case that the resin material includes polyester resin, the acid value of the polyester resin is preferably 5 mg KOH/g or greater and 20 mg KOH/g or less, and more preferably 5 mg KOH/g or greater and 15 mg KOH/g or less. The content ratio of the polyester resin in the resin is preferably 50% by mass or greater, and more preferably 60% by mass or greater.

The glass transition temperature (Tg) of the resin used in the invention is preferably 15° C. or higher and 70° C. or less, and more preferably 20° C. or higher and 55° C. or less. In the present specification, "glass transition temperature" is the temperature where the extension of a base line equal to or lower than the glass transition temperature intersects with the tangent line that indicates the maximum slope from the rising portion of the peak to the top of the peak in a measurement using a sample weight of 10 mg, a temperature increase rate of 10° C./min, and a measured temperature range of 10 to 150° C. in a DSC-220C differential scanning calorimeter (manufactured by SII).

The softening point (T1/2) of the resin is also not particularly limited, and is preferably 50° C. or higher and 130° C. or lower, more preferably 50° C. or higher and 120° C. or lower, and more preferably 60° C. or higher and 115° C. or lower. In the present specification, the softening temperature is the temperature at which softening begins under measurement conditions of a temperature increase rate of 5° C./min and a die hole diameter of 1.0 mm in a Koka flow tester (manufactured by Shimadzu Seisakusho).

Colorant

The colorant used in the invention is not particularly limited, and a publicly known pigment, dye, or the like, for example can be used.

Other Components

The kneaded product can include components other than those described above. Such components can include publicly known waxes, magnetic powder, or the like, for example. Besides materials such as those described above, zinc stearate, zinc oxide, cerium oxide, silica, titanium oxide, iron oxide, fatty acids, fatty acid metal salts, and the like, for example, can be used as constituent materials (components) of the kneaded product.

Coarse Pulverization Step

The kneaded product obtained in the step described above is then coarsely pulverized to obtain a coarse pulverized product. The use of a coarse pulverized product obtained by coarsely pulverizing the kneaded product makes it possible to more effectively reduce the particle diameter of the toner particles in the pulverization step (fine pulverization step) described hereinafter. The method of coarse pulverization is not particularly limited, and coarse pulverization can be performed using a ball mill, a vibrating mill, a jet mill, a pin mill, or various other pulverizing devices or grinding devices, for example. The average particle diameter of the coarse pulverized product obtained in the coarse pulverization step is preferably 30 μm or greater and 1000 μm or less. The pulverization step can be divided into multiple processes.

Pulverization Step (Fine Pulverization Step)

The coarse pulverized product obtained in the step described above is then wet-pulverized in a liquid insulator having a viscosity of 20 cs or greater at 20° C. (pulverization step). In the pulverization step, the liquid insulator includes an acrylic-modified silicone which is essentially insoluble in the liquid insulator, and a solvent in which the acrylic-modified silicone is insoluble, whereas the solvent is soluble in the liquid insulator. Including such a component enables efficient pulverization. Reasons for this are described below. Specifically, the acrylic-modified silicone which exists stably in the liquid insulator is affixed by the solvent on the periphery of the pulverized product formed during pulverization. Since the affixed acrylic-modified silicone is harder than the polyester resin, pulverization progresses with the affixed acrylic-modified silicone as the starting point. Pulverization is thought to progress efficiently for this reason. In the present step, a dispersion is obtained in which resin microparticles including the polyester resin and the colorant are dispersed in the liquid insulator, the acrylic-modified silicone being affixed to the surfaces of the resin microparticles. The method of pulverization in the present step is not particularly limited, and pulverization can be performed using a ball mill, a vibrating mill, a jet mill, a pin mill, or various other pulverizing devices or grinding devices, for example.

Each component is described below.

Liquid Insulator

Wet pulverization in the present step is performed in a liquid insulator. The liquid insulator functions as a dispersion medium for dispersing the toner particles in the liquid developer ultimately obtained. The liquid insulator is highly insulative so as to cause the charged toner particles to be transferred during image formation.

The liquid insulator used in the invention has a viscosity of 20 cs or greater at 20° C. The use of a liquid insulator having such a viscosity makes it possible to suppress dissolution of the acrylic-modified silicone in the liquid insulator, and to enable reliable affixing to the surface of the pulverized product during pulverization. The viscosity of the liquid insulator is 20 cs or greater at 20° C., but a viscosity of 20 cs or greater and 300 cs or less is more preferred. Pulverization can thereby be performed more efficiently. The liquid insulator can be any liquid that is insulative to an adequately high degree, but the liquid insulator specifically has an electrical resistance at room temperature (20° C.) of preferably $1\times10^{9}$ Ωcm or greater, more preferably $1\times10^{11}$ Ωcm or greater, and more preferably $1\times10^{13}$ Ωcm or greater. The relative permittivity of the liquid insulator is preferably 3.5 or less.

Examples of liquid insulators include KF-99, KF-96, and KF-995 (all manufactured by Shin-Etsu Chemical Co., Ltd.), AK35, AK50, AK100, AK350, and AK1000 (all manufactured by Wacker Chemie AG), SH200, SH510, and SH8400 (all manufactured by Toray Dow Corning), and other silicone oils; Isopar E, Isopar G, Isopar H, and Isopar L (Isopar; trade name of Exxon Chemical), Shellsol 70 and Shellsol 71 (Shellsol; trade name of Shell Oil), Amsco OMS and Amsco 460 solvents (Amsco; trade name of American Mineral Spirits Company), low-viscosity/high-viscosity liquid paraffin (Wako Pure Chemical Industries, Ltd.) and other mineral oils (hydrocarbon-based liquids); and fatty acid glycerides, fatty acid monoesters, medium-chain fatty acid esters, and other fatty acid esters or vegetable oils containing the same; and these can be used singly or in combinations of two or more types thereof. In the present step, among the liquid insulators described above, silicone oil is preferably used as the liquid insulator. The liquid developer can thereby be obtained with particularly excellent productivity, and the toner particles can be endowed with particularly excellent dispersion stability in the liquid developer.

Acrylic-Modified Silicone

In the present step, the liquid insulator includes an acrylic-modified silicone that is essentially insoluble in the liquid insulator. The inclusion of an acrylic-modified silicone enables the acrylic-modified silicone to be affixed to the surfaces of the toner particles ultimately obtained, and for the liquid developer to be endowed with excellent positive charging characteristics.

The quality of being "essentially insoluble" is obtained by removing the solvent of the active ingredient (in this case, the polymer component of the acrylic-modified silicone). Solubility is determined visually by dissolving the active ingredient (solid) in a carrier (liquid insulator) using a certain ratio/time/temperature (1.0 wt %, 3 hours stirring, 25° C.). In the case of FA4002ID (Manufactured by Toray Dow Corning), for example, the active ingredient does not dissolve at all in the carrier and retains the shape thereof, and such cases are labeled ○. By visual determination, cases in which the shape breaks down and about half of the substance dissolves are labeled Δ, and cases in which no recognizable shape remains and the substance dissolves are labeled x (three levels). Here, "essentially insoluble" corresponds to the state labeled ○.

An (acrylates/polytrimethylsiloxy methacrylate) copolymer, for example, or the like can be used as the acrylic-modified silicone. Specifically, the monomer component constituting the acrylic-based polymer is not particularly limited, and examples thereof include acrylic acid, methacrylic acid, acrylic acid alkyl esters, methacrylic acid alkyl esters, and other acrylic acid or methacrylic acid derivatives, and these can be used singly or in combinations of two or more types thereof. Examples of acrylic-based polymers composed of the monomer components described above include polymers composed of one or more types of monomers selected from acrylic acid, methacrylic acid, and alkyl esters thereof, where the alkyl groups of the monomers (acrylates) have a carbon number of 4 or less. The acrylic-modified silicone can also be composed of a plurality of types of acrylic-based polymers. The acrylic-based polymers constituting the acrylic-modified silicone are preferably acrylates and acrylic acid alkyl esters, and acrylates and ethylhexyl acrylate are more preferred. The effects of the acrylic-modified silicone described above can thereby be more significantly obtained, and the toner particles can be endowed with particularly excellent dispersion stability in the liquid developer. The acrylic-based polymer can also be composed of monomer components other than those described above. The polysiloxane constituting the acrylic-modified silicone is also not particularly limited, examples thereof include dimethylpolysiloxane and other dialkyl polysiloxanes, and diphenylpolysiloxane and other diaryl polysiloxanes, and these can be used singly or in combinations of two or more types thereof. Among the above examples, dialkyl siloxane is preferably included, and dimethylpolysiloxane is more preferably included as the polysiloxane. The effects of the acrylic-modified silicone such as described above can thereby be more significantly obtained, and the toner particles can be endowed with particularly excellent dispersion stability in the liquid developer. A side chain or terminal end of the polysiloxane constituting the acrylic-modified silicone can also be substituted with another functional group or the like. For example, acrylic acid and methacrylic acid can be added to a side chain or terminal end of the polysiloxane. In this case, the toner particles can be endowed with particularly excellent dispersion stability in the liquid developer. The polysiloxane described above can be straight-chain or branched. The acrylic-based silicone is obtained by graft polymerization of an acrylic-based polymer and a polysiloxane. This process causes the acrylic-modified silicone to have numerous branched chains and to be bulky. As a result, the portion having relatively large polarity (acrylic-based polymer portion) and the portion having relatively small polarity (polysiloxane portion) can adequately demonstrate the functions thereof.

The use of an (acrylates/polytrimethylsiloxy methacrylate) copolymer enables the toner particles to be endowed with particularly excellent positive charging characteristics, and particularly excellent dispersion stability of the toner particles in the liquid developer ultimately obtained, and particularly excellent storage stability of the liquid developer can also be obtained. Since aggregation of particles can be more effectively prevented during manufacturing (particularly in the heating step described in detail hereinafter) of the liquid developer, the liquid developer can be obtained with particularly excellent productivity, for example. Specific examples of acrylic-modified silicones include FA40021D (manufactured by Toray Dow Corning), KP545 (manufactured by Shin-Etsu Chemical Co., Ltd.), FA4001CM (manufactured by Toray Dow Corning), and the like.

In the present step, the used amount of the acrylic-modified silicone is preferably such that the content ratio thereof (the acrylic-modified silicone polymer component, not including the solvent) in the liquid developer ultimately obtained is 0.5% by mass or greater and 10.0% by mass or less, and more preferably 1.0% by mass or greater and 7.0% by mass or less. Particularly excellent dispersion stability of the toner particles in the liquid developer can thereby be obtained while the toner particles are endowed with particularly excellent charging characteristics. The liquid developer can also be endowed with particularly excellent development and transfer characteristics.

Solvent

The solvent is a volatile component that has the function of stably dispersing the acrylic-modified silicone in the liquid insulator. Examples of such a solvent can include isododecane, octane, isooctane, decane, isodecane, decalin, nonane, dodecane, cyclohexane, cyclooctane, cyclodecane, and other aliphatic hydrocarbons; and cyclopentasiloxane and other siloxanes. Among these, in the case that an aliphatic hydrocarbon (particularly isodecane) is used, the acrylic-modified silicone can be made to exist more stably in the liquid insulator, and the acrylic-modified silicone can be more reliably affixed to the surfaces of the toner particles. Also in the case that a siloxane (particularly cyclopentasiloxane) is used, the acrylic-modified silicone can be made to exist more stably in the liquid insulator, and the acrylic-modified silicone can be more reliably affixed to the surfaces of the toner particles.

If the roundness of a measured particle is expressed as $L_0/L_1$, where $L_1$ (μm) is the circumference of a profile view of the measured particle and $L_0$ (μm) is the circumference of a perfect circle of equal area to the profile view of the measured particle, the present step is preferably performed so that the average roundness $R_0$ of the particles included in the dispersion (dispersion prior to the heat treatment described hereinafter) obtained by the present step satisfies the following relationship: $0.800 \leq R_0 \leq 0.889$. Particularly excellent uniformity of charging characteristics between toner particles can thereby be obtained, and the liquid developer can be endowed with particularly excellent storage stability, transfer efficiency, and other characteristics.

Other Components

In the present step, the liquid insulator can include a quaternary cationic silicone, an aminophenyl-modified silicone, a phenyl-modified silicone, a silanol-containing polysiloxane, or the like. The liquid developer can thereby be endowed with more excellent positive charging characteristics. These components can be added after the heating step described hereinafter.

A quaternary cationic silicone is a silicone that has a quaternary ammonium group, and a "silicone that has a quaternary ammonium group" is termed to mean any silicone that has one or more quaternary ammonium groups. These quaternary ammonium groups can be bonded in alpha or omega positions in the form of lateral groups, and can be directly bonded to a polysiloxane backbone or supported by a hydrocarbon base chain.

In the invention, the term "silicone" is generally allowed as meaning any polymer having a structure based on bonding between silicon and oxygen atoms by a bond known as a siloxane bond (—Si—O—Si—), further characterized by the presence of a silicon-carbon bond. Such silicones or polysiloxanes are generally obtained by polycondensation of appropriately functionalized silanes. The hydrocarbon base groups most often supported by a silicon atom are lower alkyl groups, particularly methyl, and fluoroalkyl and aryl groups, particularly phenyl. Such silicones are marketed under the names ABIL Quat 3272, ABIL B9905, ABIL Quat 3474, and ABIL K3270 from Goldschmidt; Silquat Q-100, Silquat Q-200WS, Silquat AX, Silquat AC, Silquat AD, and Silquat AM (all manufactured by Siltech) from Lipo France; and Magnasoft Exhaust and Silsoft C-880 from OSI; Pecosil 14-PQ and Pecosil 36-PQ (manufactured by Phoenix Chemical) from UCIB, for example.

These silicones are described in particular in European Patent No. 530974, German Patent No. 3719086, German Patent No. 3705121, European Patent No. 617607, and European Patent No. 714654. Among silicones, SilSense Q-Plus (manufactured by Lubrizol Corporation) is particularly preferred. The use of SilSense Q-Plus (manufactured by Lubrizol Corporation) as substance B enables the toner particles to be endowed with particularly excellent positive charging characteristics, and excellent dispersion stability of the toner particles in the liquid developer ultimately obtained, and excellent storage stability of the liquid developer can also be obtained.

Examples of aminophenyl-modified silicones include aminopropyl phenyl trimethycone and the like. The use of aminopropyl phenyl trimethylcone as substance B enables the toner particles to be endowed with particularly excellent positive charging characteristics, and particularly excellent dispersion stability of the toner particles in the liquid developer ultimately obtained, and particularly excellent storage stability of the liquid developer can also be obtained.

Specific examples of aminophenyl-modified silicones include 2-2078 Fluid (manufactured by Toray Dow Corning) and the like. Examples of phenyl-modified silicones include phenyl siloxy silicate resin, trimethyl pentaphenyl trisiloxane, and the like. The use of phenyl siloxy silicate resin and trimethyl pentaphenyl trisiloxane as substance B enables the toner particles to be endowed with particularly excellent positive charging characteristics, and particularly excellent dispersion stability of the toner particles in the liquid developer ultimately obtained, and particularly excellent storage stability of the liquid developer can also be obtained. Specific examples of phenyl-modified silicones include SH556 (manufactured by Toray Dow Corning), PH1555 (manufactured by Toray Dow Corning), Silshine 151 (manufactured by Momentive), and the like.

A silanol-containing polysiloxane having an M unit ($R^1R^2R^3SiO_{1/2}$) and a Q unit ($SiO_{4/2}$) can be suitably used as the silanol-containing polysiloxane (where $R^1$, $R^2$, and $R^3$ are each independently a monovalent aliphatic hydrocarbon group having a carbon number of 1 or greater and 10 or less or a monovalent aromatic hydrocarbon group having a carbon number of 6 or greater and 15 or less). Particularly excellent dispersion stability of the toner particles in the liquid developer can thereby be obtained while the toner particles are endowed with particularly excellent charging characteristics. The liquid developer can also be endowed with particularly excellent development and transfer characteristics.

Examples of silanol-containing polysiloxanes include tetra(trimethylsiloxy)silane and the like. The use of tetra(trimethylsiloxy)silane as substance C enables the toner particles to be endowed with particularly excellent positive charging characteristics, and particularly excellent dispersion stability of the toner particles in the liquid developer and storage stability of the liquid developer can be obtained. Specific examples of silanol-containing polysiloxanes include DC593 (manufactured by Toray Dow Corning), SS4267 (manufactured by Momentive), SS4230 (manufactured by Momentive), and the like.

Heating Step

The dispersion obtained via the wet pulverization step is then heat-treated. In particular, heat treatment is performed at a temperature higher than the glass transition temperature of the polyester resin. A liquid developer in which the toner particles are dispersed in the liquid insulator is thereby obtained. By the present step, the acrylic-modified silicone can be reliably affixed near the surfaces of the resin microparticles, and the roundness of the particles can be adjusted to the appropriate level. As a result, the toner particles constituting the liquid developer ultimately obtained can be endowed with excellent positive charging characteristics, and the toner particles can be endowed with excellent dispersion stability in the liquid developer. The toner particles can also be endowed with excellent transfer efficiency, development efficiency, and other characteristics. By controlling the particle shape (roundness), the viscosity can also be controlled. As a result, the charging characteristics can be enhanced.

The treatment temperature in the present step is preferably Tg [° C.] or higher and (Tg+30) [° C.] or lower, more preferably Tg [° C.] or higher and Tg+20 [° C.] or lower, and more preferably Tg+5 [° C.] or higher and Tg+10 [° C.] or lower, where Tg [° C.] is the glass transition temperature of the resin material. Such effects as those described above are thereby more significantly demonstrated, and the liquid developer can be obtained with particularly excellent productivity. If the polyester resin constituting the coarse pulverized product is composed of a plurality of types of components (resin components), the glass transition temperature of the mixture as a whole is used as Tg.

The heat treatment time in the present step is preferably 5 minutes or greater and 150 minutes or less, and more preferably 10 minutes or greater and 90 minutes or less. Such effects as those described above are thereby more significantly demonstrated, and the liquid developer can be obtained with particularly excellent productivity. The present step is also performed by heating while applying a shearing force to the dispersion. The toner particles can thereby be endowed with particularly excellent charging characteristics, and the liquid developer can be endowed with particularly excellent storage stability, transfer efficiency, and other characteristics. In the case that the present step is performed while applying a shear, the shear is preferably 300 rpm or greater and 1200 or less, and more preferably 400 rpm or greater and 900 rpm or less.

If the roundness of a measured particle is expressed as $L_0/L_1$, where $L_1$ (μm) is the circumference of a profile view of the measured particle and $L_0$ (μm) is the circumference of a perfect circle of equal area to the profile view of the measured particle, the present step is preferably performed so that $R_1$ is 0.890 or greater, where $R_1$ is the average roundness of the particles included in the dispersion after the present step (after heat treatment), and so that the average roundness $R_0$ of the particles included in the dispersion prior to the present step (prior to heat treatment) and the average roundness $R_1$ satisfy the following relationship: $0.01 \leq R_1 - R_0 \leq 0.10$. Particularly excellent uniformity of charging characteristics between toner particles can thereby be obtained, and the liquid developer can be endowed with particularly excellent storage stability, transfer efficiency, and other characteristics.

As described above, $R_1$ can be 0.890 or greater, preferably 0.895 or greater and 0.970 or less, and more preferably 0.900 or greater and 0.960 or less. Such effects as those described above are thereby more significantly demonstrated. The relationship $0.01 \leq R_1 - R_0 \leq 0.10$ is preferably satisfied, but the relationship $0.02 \leq R_1 - R_0 \leq 0.09$ is more preferably satisfied, and the relationship $0.03 \leq R_1 - R_0 \leq 0.08$ is more preferably satisfied. Such effects as those described above are thereby more significantly demonstrated.

The roundness of the particles is measured using an FPIA-3000, FPIA-30005 (each manufactured by Sysmex), or other flow particle image analyzer, for example. Such a device employs a scheme for measuring particles dispersed in a dispersion medium by flow image analysis, in which a suctioned particle suspension is introduced to a flat sheath flow cell and a flat sample flow is formed by a sheath liquid. The sample flow is irradiated by a strobe light, and an image of the particles is captured using a CCD camera. The roundness described above is computed using the circumference obtained from an image of the particles which is subjected to two-dimensional image processing. A mixing step of mixing the dispersion and other components can be provided subsequent to the present heating step. The toner particles can thereby be endowed with more excellent dispersion stability in the liquid insulator, and particularly excellent dispersion stability can be obtained.

The dispersant is not particularly limited, and silicone resin can be used. The toner particles can thereby be endowed with particularly excellent dispersion stability in the liquid insulator. Silicone resin is a polymer having a three-dimensional structure obtained by co-hydrolysis of an organosilane compound followed by a condensation reaction, and much is known about the characteristics and the method for producing silicone resin, as well as the method for curing the resin and the physical properties of the cured product (Ito, Kunio ed., *Silicone Handbook*, p. 468, Nikkan Kogyo Shimbun, Ltd.; *Chemistry and Technology of Silicones, 2nd* Edition, p. 409, Walter Noll Academic Press, Inc. (London) Ltd. 1968).

Silicone resins include those (so-called DT resins) created by co-hydrolysis of trifunctional (silane compound having three hydrolyzable functional groups, giving siloxane units referred to as T units) and bifunctional (silane compound having two hydrolyzable functional groups, giving siloxane units referred to as D units) hydrolyzable silane compounds; those (so-called polysilsesquioxanes) created by hydrolysis of only trifunctional hydrolyzable silane compounds; those (so-called MQ resins) created by co-hydrolysis of monofunctional (silane compound having one hydrolyzable functional group, giving siloxane units referred to as M units; refer to Table 1) silane compounds and silane compounds in which all of the functional groups are hydrolyzable (tetrafunctional=giving Q units; refer to Table 1), such as silicon tetrachloride; and mixtures of the above compounds. An M unit is $—OSiR_3$, a D unit is $(—O)_2SiR_2$, a T unit is $(—O)_3SiR$ Si, and a Q unit is $(O—)_4$. Specific examples include TSF4600 (Momentive Performance Materials Japan LLC), DC593 (Toray Dow Corning), and the like, and these can be used singly or in combinations of two or more types thereof.

Liquid Developer

The liquid developer of the invention is a liquid developer including a liquid insulator and toner particles which include a resin material, a colorant, a substance A, a substance B, and a substance C, wherein if the roundness of a measured particle is expressed as $L_0/L_1$, where $L_1$ (μm) is the circumference of a profile view of the measured particle and $L_0$ (μm) is the circumference of a perfect circle of equal area to the profile view of the measured particle, the average roundness $R_1$ of the toner particles is 0.930 or greater. A liquid developer can thereby be provided having excellent positive charging characteristics.

The liquid developer of the invention can be manufactured using a method such as described above. The content ratio of the toner particles in the liquid developer is preferably 10% by mass or greater and 60% by mass or less, and more preferably 20% by mass or greater and 50% by mass or less. The volume-average particle diameter ($D_{50}$) of the toner particles which constitute the liquid developer is preferably 2 μm or greater and 4 μm or less.

In the present specification, the volume-average particle diameter ($D_{50}$) is the "sphere-equivalent 50% average particle diameter ($D_{50}$) obtained by a light scattering method," and the value thereof is obtained as described below. Specifically, light is radiated to a particle in a dispersion medium and diffracted scattered light that occurs is measured by detectors placed at the front, rear, and sides of the dispersion medium. Using the measured value and assuming a spherical shape for a normally amorphous particle, an accumulation curve is calculated with the total volume of a particle aggregate substituted with a sphere of equal volume to the particle as 100%, and the point at which the cumulative value is 50% is designated as the volume-average particle diameter. The measurement device can be a Microtrac MT-3000 laser diffraction/scattering particle size analyzer (manufactured by Nikkiso Co., Ltd.), for example, or the like. The volume-average particle diameter ($D_{50}$) in the examples described hereinafter is measured by the aforementioned Microtrac MT-3000.

The liquid developer can include components other than those described above. Such components can include publicly known waxes, magnetic particles, zinc stearate, zinc oxide, cerium oxide, silica, titanium oxide, iron oxide, fatty acids, fatty acid metal salts, dispersants, external additives, publicly known antioxidants, antistatic agents, and the like, for example. Such components can be used in any step of the manufacturing method described above. Specifically, such components can be included in the particles used in the wet pulverization step or can be added during the wet pulverization step, the heating step, or the mixing step.

Image Formation Device

Preferred embodiments of an image formation device to which the liquid developer of the invention is applied will next be described. FIG. 1 is a schematic view showing a preferred embodiment of an image formation device in which the liquid developer of the invention is applied, and FIG. 2 is an enlarged view showing a portion of the image formation device shown in FIG. 1.

Figure 2:
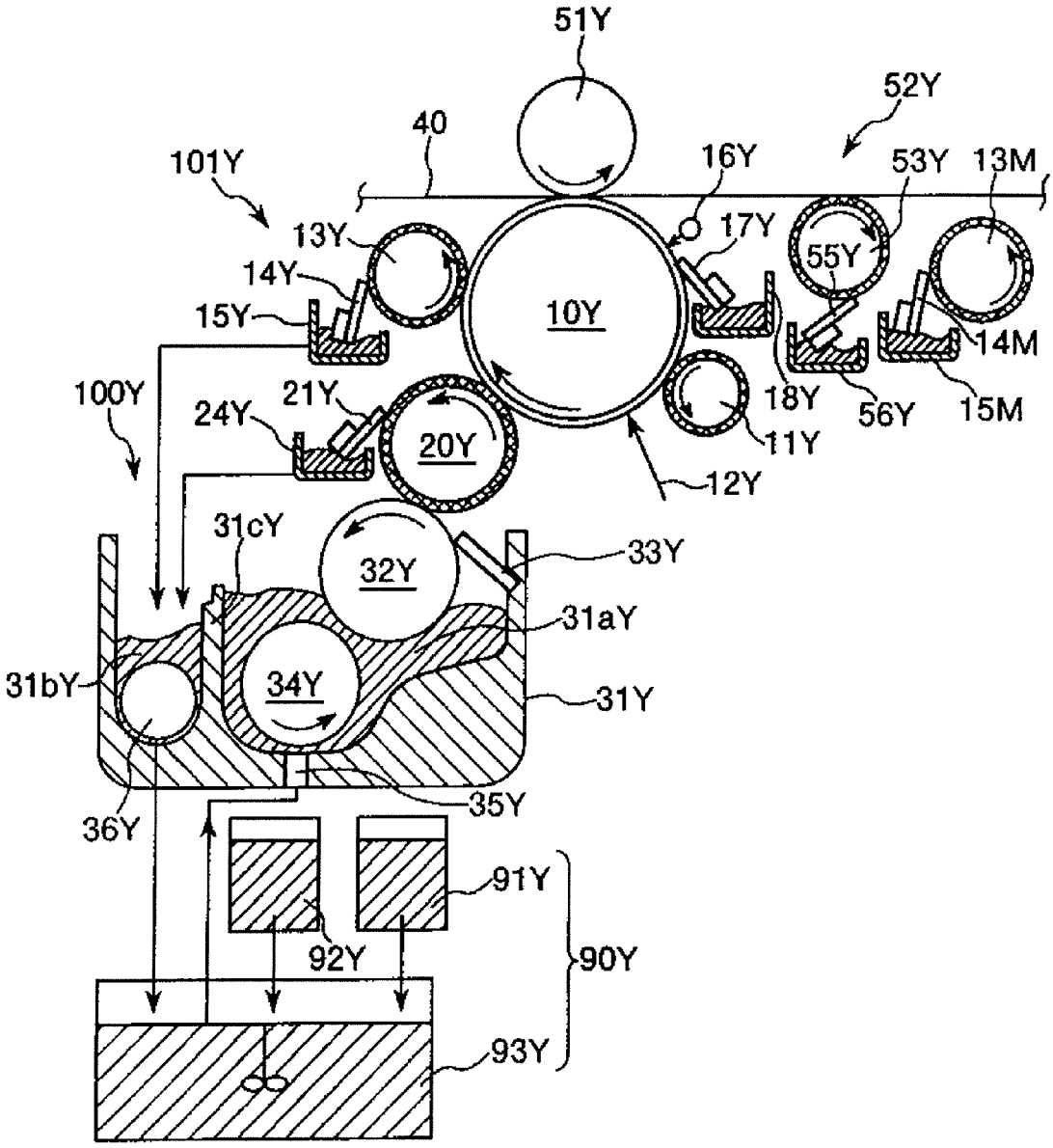
FIG. 2 is an enlarged view showing a portion of the image formation device shown in FIG. 1.

As shown in FIGS. 1 and 2, the image formation device 1000 has four development parts 30Y, 30M, 30C, 30K, a transfer part (intermediate transfer part 40 and secondary transfer unit (secondary transfer part) 60), a fixing part (fixing device) F40, and four liquid developer supply parts 90Y, 90M, 90C, 90K. The development parts 30Y, 30M, 30C have the function of developing a latent image by a yellow-based liquid developer (Y), a magenta-based liquid developer (M), and a cyan-based liquid developer (C), respectively, and forming a monochrome image in each corresponding color. The development part 30K has the function of developing a latent image by a black-based liquid developer (K) and forming a black monochrome image.

The development parts 30Y, 30M, 30C, 30K are each configured in the same manner, and the development part 30Y is described below. As shown in FIG. 2, the development part 30Y has a photoreceptor 10Y, which is an example of an image support, and in the rotation direction of the photoreceptor 10Y, the development part 30Y has a charging roller 11Y, an exposure unit 12Y, a development unit 100Y, a photoreceptor squeeze device 101Y, a primary transfer backup roller 51Y, a charge removal unit 16Y, a photoreceptor cleaning blade 17Y, and a developer recovery part 18Y.

The photoreceptor 10Y has a cylindrical substrate and a photosensitive layer composed of amorphous silicon, for example, or another material formed on the external peripheral surface thereof, and the photoreceptor 10Y is capable of rotating about a central axis. In the present embodiment, the photoreceptor 10Y rotates clockwise as indicated by the arrow in FIG. 2. The liquid developer is fed by the development unit 100Y described hereinafter to the photoreceptor 10Y to form a layer of the liquid developer on the surface of the photoreceptor 10Y.

The charging roller 11Y is a device for charging the photoreceptor 10Y, and the exposure unit 12Y is a device for forming a latent image on the photoreceptor 10Y charged by laser irradiation. The exposure unit 12Y has a semiconductor laser, a polygon mirror, an F-θ lens, and other components, and irradiates onto the photoreceptor 10Y a laser that is modulated based on an image signal inputted from a personal computer, word processor, or other host computer not shown in the drawing. The development unit 100Y is a device for using the liquid developer of the invention to develop the latent image that is formed on the photoreceptor 10Y. The development unit 100Y is described in detail hereinafter.

The photoreceptor squeeze device 101Y is disposed downstream in the rotation direction from the development unit 100Y so as to face the photoreceptor 10Y, and is composed of a photoreceptor squeeze roller 13Y, a cleaning blade 14Y for pushing against the photoreceptor squeeze roller 13Y to remove the liquid developer that adheres to the surface of the photoreceptor squeeze roller 13Y, and a developer recovery part 15Y for recovering the removed liquid developer. The photoreceptor squeeze device 101Y has the function of recovering the excess carrier (liquid insulator) and naturally unnecessary fogging toner from the developer that is developed on the photoreceptor 10Y, and increasing the toner particle ratio in the visualization.

The primary transfer backup roller 51Y is a device for transferring the monochrome image formed on the photoreceptor 10Y to the intermediate transfer part 40 described hereinafter. The charge removal unit 16Y is a device for removing the residual charge on the photoreceptor 10Y after the intermediate transfer image has been transferred onto the intermediate transfer part 40 by the primary transfer backup roller 51Y. The photoreceptor cleaning blade 17Y is a rubber member in contact with the surface of the photoreceptor 10Y, and has the function of scraping off the liquid developer that remains on the photoreceptor 10Y after an image has been transferred onto the intermediate transfer part 40 by the primary transfer backup roller 51Y. The developer recovery part 18Y has the function of recovering the liquid developer removed by the photoreceptor cleaning blade 17Y.

The intermediate transfer part 40 is an endless elastic belt member that is passed along a pair of following rollers 44, 45 and a belt drive roller 41 to which the drive force of a motor not shown in the drawings is transmitted. The intermediate transfer part 40 is driven in counterclockwise rotation by the belt drive roller 41 while being placed in contact with the photoreceptors 10Y, 10M, 10C, 10K by the primary transfer backup rollers 51Y, 51M, 51C, 51K. Furthermore, the intermediate transfer part 40 is configured so that a predetermined tension is imparted thereto by a tension roller 49 to remove slack. The tension roller 49 is disposed downstream in the rotation (movement) direction of the intermediate transfer part 40 from one following roller 44 and upstream in the rotation (movement) direction of the intermediate transfer part 40 from the other following roller 45. The monochrome images corresponding to each color that are formed on the development parts 30Y, 30M, 30C, 30K are sequentially transferred by the primary transfer backup rollers 51Y, 51M, 51C, 51K, and the monochrome images corresponding to each color are superposed on the intermediate transfer part 40. A full-color developer image (intermediate transfer image) is thereby formed on the intermediate transfer part 40.

The monochrome images formed on the plurality of photoreceptors 10Y, 10M, 10C, 10K thus sequentially undergo secondary transfer to be superposed and supported on the intermediate transfer part 40, and undergo secondary transfer to a paper, film, cloth, or other recording medium F5 at once in the secondary transfer unit 60 described hereinafter. Therefore, in transferring the toner image to the recording medium F5 in the secondary transfer process, even when the surface of the recording medium F5 is a fibrous or otherwise non-smooth sheet material, the elastic belt member is employed for enhancing secondary transfer characteristics in imitation of this non-smooth sheet surface.

A cleaning device composed of an intermediate transfer part cleaning blade 46, a developer recovery part 47, and a non-contact bias application member 48 is disposed on the intermediate transfer part 40. The intermediate transfer part cleaning blade 46 and the developer recovery part 47 are provided on the side of the following roller 45. The intermediate transfer part cleaning blade 46 has the function of scraping off the liquid developer adhering to the intermediate transfer part 40 after the toner image has been transferred onto the recording medium F5 by the secondary transfer unit (secondary transfer part) 60.

The developer recovery part 47 has the function of recovering the liquid developer that has been removed by the intermediate transfer part cleaning blade 46. The non-contact bias application member 48 is disposed apart from the intermediate transfer part 40 in a position facing the tension roller 49. The non-contact bias application member 48 applies a bias voltage of opposite polarity to the toner (solid portion) of the liquid developer that remains on the intermediate transfer part 40 after secondary transfer. The electric charge of the toner is thereby removed, and the electrostatic attraction of the toner to the intermediate transfer part 40 is reduced. In this example, a corona charger is used as the non-contact bias application member 48.

The non-contact bias application member 48 can not necessarily be disposed in a position facing the tension roller 49, and can be disposed in a position between the following roller 44 and the tension roller 49, for example, or in any position downstream in the movement direction of the intermediate transfer part from the following roller 44 and upstream in the movement direction of the intermediate transfer part from the following roller 45. The non-contact bias application member 48 can also use a publicly known non-contact charger other than a corona charger.

The intermediate transfer part squeeze device 52Y is provided downstream in the movement direction of the intermediate transfer part 40 from the primary transfer backup roller 51Y. The intermediate transfer part squeeze device 52Y is provided for removing excess liquid insulator from the transferred liquid developer in the case that the liquid developer transferred onto the intermediate transfer part 40 does not have the desired dispersion state.

The intermediate transfer part squeeze device 52Y is composed of an intermediate transfer part squeeze roller 53Y, an intermediate transfer part squeeze cleaning blade 55Y for pushing against the intermediate transfer part squeeze roller 53Y to clean the surface thereof, and a developer recovery part 56Y for recovering the liquid developer that has been removed by the intermediate transfer part squeeze cleaning blade 55Y. The intermediate transfer part squeeze device 52Y has the function of recovering the excess liquid insulator from the developer that has undergone primary transfer to the intermediate transfer part 40 to increase the toner particle ratio in the image, and recovering the naturally unnecessary fogging toner.

The secondary transfer unit 60 is provided with a pair of secondary transfer rollers disposed a predetermined distance apart from each other in the movement direction of the transfer material. In this pair of secondary transfer rollers, the secondary transfer roller disposed on the upstream side in the movement direction of the intermediate transfer part 40 is an upstream secondary transfer roller 64. The upstream secondary transfer roller 64 is capable of pressing against the belt drive roller 41 via the intermediate transfer part 40.

In the pair of secondary transfer rollers, the secondary transfer roller disposed on the downstream side in the movement direction of the transfer material is a downstream secondary transfer roller 65. The downstream secondary transfer roller 65 is capable of pressing against the following roller 44 via the intermediate transfer part 40. Specifically, the upstream secondary transfer roller 64 and the downstream secondary transfer roller 65 bring the recording medium F5 into contact with the intermediate transfer part 40 which is passed along the belt drive roller 41 and the following roller 44, and cause secondary transfer to the recording medium F5 of the intermediate transfer image that is formed of superposed colors on the intermediate transfer part 40.

In this case, the belt drive roller 41 and the following roller 44 function also as backup rollers of the upstream secondary transfer roller 64 and the downstream secondary transfer roller 65, respectively. Specifically, the belt drive roller 41 serves also as an upstream backup roller disposed upstream in the movement direction of the recording medium F5 from the following roller 44 in the secondary transfer unit 60. The following roller 44 serves also as a downstream backup roller disposed downstream in the movement direction of the recording medium F5 from the belt drive roller 41 in the secondary transfer unit 60.

Consequently, the recording medium F5 conveyed by the secondary transfer unit 60 is brought into close contact with the intermediate transfer part 40 in a predetermined movement region of the transfer material from the pressing start position (nip start position) of the upstream secondary transfer roller 64 and the belt drive roller 41 to the pressing end position (nip end position) of the downstream secondary transfer roller 65 and the following roller 44. The full-color intermediate transfer image on the intermediate transfer part 40 thereby undergoes secondary transfer during a predetermined time to the recording medium F5 which is in close contact with the intermediate transfer part 40, and secondary transfer is therefore performed satisfactorily.

The secondary transfer unit 60 is provided with a secondary transfer roller cleaning blade 66 and a developer recovery part 67 for the upstream secondary transfer roller 64. The secondary transfer unit 60 is also provided with a secondary transfer roller cleaning blade 68 and a developer recovery part 69 for the downstream secondary transfer roller 65. The secondary transfer roller cleaning blades 66, 68 are placed in contact with the secondary transfer rollers 64, 65, respectively, and scrape off the liquid developer that remains on the surfaces of the secondary transfer rollers 64, 65 after secondary transfer. The developer recovery parts 67, 69 recover and store the liquid developer that has been scraped from the secondary transfer rollers 64, 65 by the secondary transfer roller cleaning blades 66, 68.

The toner image (transfer image) transferred onto the recording medium F5 by the secondary transfer unit 60 is sent to the fixing part (fixing device) F40 and fixed on the recording medium F5 by heating and pressing. The fixing temperature (set temperature), specifically, is preferably 80° C. or higher and 160° C. or lower, more preferably 100° C. or higher and 150° C. or lower, and more preferably 100° C. or higher and 140° C. or lower.

The development units 100Y, 100M, 100C, 100K will next be described in detail. The development unit 100Y will be described below as representing the development units. As shown in FIG. 2, the development unit 100Y has a liquid developer storage part 31Y, an application roller 32Y, a regulation blade 33Y, a developer stirring roller 34Y, a communicating part 35Y, a recovery screw 36Y, a development roller 20Y, and a development roller cleaning blade 21Y.

The liquid developer storage part 31Y has the function of storing the liquid developer for developing the latent image formed on the photoreceptor 10Y, and is provided with a feeding part 31*a*Y for feeding the liquid developer to the development part, a recovery part 31*b*Y for recovering the excess liquid developer generated by the feeding part 31*a*Y and other components, and a partition 31*c*Y for partitioning the feeding part 31*a*Y and the recovery part 31*b*Y. The feeding part 31*a*Y has the function of feeding the liquid developer to the application roller 32Y, and has a concave portion in which the developer stirring roller 34Y is provided. The liquid developer is fed through the communicating part 35Y to the feeding part 31*a*Y from a liquid developer mixing tank 93Y. The recovery part 31*b*Y recovers any excessive amount of liquid developer that is fed to the feeding part 31*a*Y, or excess liquid developer that occurs in the developer recovery parts 15Y, 24Y. The recovered liquid developer is conveyed to the liquid developer mixing tank 93Y described hereinafter and reused. The recovery part 31*b*Y has a concave portion, and the recovery screw 36Y is provided near the bottom of the recovery part 31*b*Y.

A wall-shaped partition 31*c*Y is provided at the boundary of the feeding part 31*a*Y and the recovery part 31*b*Y. The partition 31*c*Y partitions the feeding part 31*a*Y and the recovery part 31*b*Y, and is capable of preventing fresh liquid developer from mixing into the recovered liquid developer. When an excessive amount of liquid developer is fed to the feeding part 31*a*Y, the excess liquid developer can cross the partition 31*c*Y and spill over into the recovery part 31*b*Y from the feeding part 31*a*Y. The amount of liquid developer in the feeding part 31*a*Y can therefore be kept constant, and a constant volume of liquid developer fed to the application roller 32Y can be maintained. The quality of the final formed image is therefore stabilized. A notched part is provided to the partition 31*c*Y, and the liquid developer can spill over through the notched part from the feeding part 31*a*Y to the recovery part 31*b*Y.

The application roller 32Y has the function of feeding the liquid developer to the development roller 20Y. The application roller 32Y is a so-called anilox roller formed by applying a nickel plating in which grooves are uniformly and helically formed on the surface of an iron or other metallic roller, and the diameter thereof is approximately 25 mm. In the present embodiment, a plurality of grooves is formed by so-called machining, component roller, or the like at an angle with respect to the rotation direction of the application roller 32Y. This application roller 32Y comes in contact with the liquid developer while rotating counterclockwise, whereby the liquid developer in the feeding part 31*a*Y is supported in the grooves, and the supported liquid developer is conveyed to the development roller 20Y.

The regulation blade 33Y comes in contact with the surface of the application roller 32Y to regulate the amount of liquid developer on the application roller 32Y. Specifically, the regulation blade 33Y serves to scrape off the excess liquid developer on the application roller 32Y and meter the liquid developer on the application roller 32Y that is fed to the development roller 20Y. The regulation blade 33Y is composed of urethane rubber as an elastic body, and is supported by a regulation blade support member made of iron or another metal. The regulation blade 33Y is provided on the side on which the application roller 32Y rotates to emerge from the liquid developer (i.e., the right side in FIG. 2). The rubber hardness of the regulation blade 33Y is approximately 77 in terms of JIS-A, and the hardness (approximately 77) of the part of the regulation blade 33Y that is adjacent to the surface of the application roller 32Y is less than the hardness (approximately 85) of the part of the elastic layer of the development roller 20Y described hereinafter that presses against the surface of the application roller 32Y. The scraped off excess liquid developer is recovered by the feeding part 31*a*Y and reused.

The developer stirring roller 34Y has the function of stirring the liquid developer into a uniform dispersion state. The toner particles can thereby be suitably dispersed even in the case that a plurality of toner particles is aggregated. Within the feeding part 31*a*Y, the toner particles in the liquid developer have a plus charge, and the liquid developer is stirred by the developer stirring roller 34Y into a uniform dispersion state, and by the rotation of the application roller 32Y, the liquid developer is drawn up from the liquid developer storage part 31Y, the amount of liquid developer is regulated by the regulation blade 33Y, and the liquid developer is fed to the development roller 20Y. Through stirring by the developer stirring roller 34Y, the liquid developer can be caused to stably overflow toward the recovery part 31*b*Y over the partition 31*c*Y, and stagnation and compression of the liquid developer can be prevented.

Furthermore, the developer stirring roller 34Y is provided near the communicating part 35Y. The liquid developer fed from the communicating part 35Y can therefore rapidly spread, and the fluid level of the feeding part 31*a*Y can be dept stable even when liquid developer is supplied to the feeding part 31*a*Y. Providing such a developer stirring roller 34Y near the communicating part 35Y causes a negative pressure to occur in the communicating part 35Y, and the liquid developer can be naturally drawn upward.

The communicating part 35Y is provided directly below the developer stirring roller 34Y, and is a portion for communicating with the liquid developer storage part 31Y and drawing the liquid developer up toward the feeding part 31*a*Y from the liquid developer mixing tank 93Y. The communicating part 35Y is provided below the developer stirring roller 34Y, and the liquid developer fed from the communicating part 35Y is thereby stopped by the developer stirring roller 34Y, there is no rise of the fluid surface due to venting, the fluid surface is kept substantially constant, and the developer can be stably fed to the application roller 32Y. The recovery screw 36Y provided near the bottom part of the recovery part 31*b*Y is a cylindrical member having a helical rib on the outer periphery thereof, and has the function of maintaining the fluidity of the recovered liquid developer and of promoting conveyance of the liquid developer to the liquid developer mixing tank 93Y.

The development roller 20Y supports the liquid developer and conveys the liquid developer to a development position facing the photoreceptor 10Y in order for the latent image supported on the photoreceptor 10Y to be developed by the liquid developer. A liquid developer layer is formed on the surface of the development roller 20Y by the feeding of the liquid developer from the application roller 32Y described above. In the development roller 20Y, a layer of a conductive elastic body is provided on the external peripheral part of a core made of iron or other metal, and the diameter of the development roller 20Y is approximately 20 mm. The layer of the elastic body has a two-layer structure, a urethane rubber layer having a thickness of approximately 5 mm and a rubber hardness of approximately 30 according to JIS-A is provided as an inside layer, and a urethane rubber layer having a thickness of approximately 30 μm and a rubber hardness of approximately 85 according to JIS-A is provided as a surface layer (outside layer). The surface layer of the development roller 20Y acts as a pressing part, and presses against the application roller 32Y and the photoreceptor 10Y in a state of elastic deformation.

The development roller 20Y is capable of rotating about the central axis thereof, and the central axis thereof is lower than the rotational axis of the photoreceptor 10Y. The development roller 20Y also rotates in the direction (counterclockwise direction in FIG. 2) opposite the rotation direction (clockwise direction in FIG. 2) of the photoreceptor 10Y. An electric field is formed between the development roller 20Y and the photoreceptor 10Y during development of the latent image formed on the photoreceptor 10Y. In the development unit 100Y, the application roller 32Y and the development roller 20Y are separately driven by different power sources (not shown). The amount of liquid developer fed onto the development roller 20Y can be adjusted by varying the rotation speed (linear speed) ratio of the application roller 32Y and the development roller 20Y.

The development unit 100Y also has the developer recovery part 24Y and the rubber development roller cleaning blade 21Y which is in contact with the surface of the development roller 20Y. The development roller cleaning blade 21Y is a device for scraping off the liquid developer that remains on the development roller 20Y after development has been performed at the development position. The liquid developer removed by the development roller cleaning blade 21Y is recovered into the developer recovery part 24Y.

As shown in FIGS. 1 and 2, the image formation device 1000 is provided with the liquid developer supply parts 90Y, 90M, 90C, 90K for supplying the liquid developer to the development parts 30Y, 30M, 30C, 30K. The liquid developer supply parts 90Y, 90M, 90C, 90K are provided with liquid developer tanks 91Y, 91M, 91C, 91K, liquid insulator tanks 92Y, 92M, 92C, 92K, and liquid developer mixing tanks 93Y, 93M, 93C, 93K, respectively.

High-concentration liquid developer corresponding to each respective color is accommodated in the liquid developer tanks 91Y, 91M, 91C, 91K. The liquid insulator is also accommodated in each of the respective liquid insulator tanks 92Y, 92M, 92C, 92K. A predetermined amount of each high-concentration liquid developer from the liquid developer tanks 91Y, 91M, 91C, 91K, and a predetermined amount of each liquid insulator from the liquid insulator tanks 92Y, 92M, 92C, 92K is fed to each of the respective liquid developer mixing tanks 93Y, 93M, 93C, 93K.

The high-concentration liquid developer and the liquid insulator fed to each of the respective liquid developer mixing tanks 93Y, 93M, 93C, 93K are mixed and stirred by the stirring devices provided to each tank, and the liquid developer corresponding to each color that is used in the feeding parts 31*a*Y, 31*a*M, 31*a*C, 31*a*K is created. Each liquid developer created in the liquid developer mixing tanks 93Y, 93M, 93C, 93K is fed to the respective feeding part 31*a*Y, 31*a*M, 31*a*C, 31*a*K. The liquid developer recovered by the recovery part 31*b*Y is recovered in the liquid developer mixing tank 93Y and reused. The same occurs for the liquid developer mixing tanks 93M, 93C, 93K.

Image formation using the device described above is performed by a development step of forming a plurality of monochrome images corresponding to each color on the photoreceptors 10Y, 10M, 10C, 10K through use of a plurality of liquid developers (liquid developer of the invention) of different colors; a transfer step of transferring the plurality of monochrome images formed on the photoreceptors to the recording medium F5 to form an unfixed toner image in which the plurality of monochrome images is superposed on each other on the recording medium F5; and a fixing step of fixing the unfixed toner image on the recording medium F5. Through use of such a method, an image having excellent color density can easily be formed.

The invention is described above based on preferred embodiments, but the invention is not limited by these embodiments. For example, the liquid developer of the invention is not limited to application in an image formation device such as the one described above. The method for producing a liquid developer of the invention can have other steps in addition to the steps described above (the wet pulverization step, heating step, and mixing step). For example, subsequent to the wet pulverization step (between the wet pulverization step and the heating step, between the heating step and the mixing step, or after the mixing step), a step can be provided for mixing a liquid insulator having a different composition from the liquid insulator used in the wet pulverization step. Specifically, the liquid insulator used in the wet pulverization step and the liquid insulator that constitutes the liquid developer ultimately obtained can be of different compositions. By including such a step, it is possible to obtain a final liquid developer of a particularly preferred composition while obtaining particularly high process efficiency in the wet pulverization step. In the embodiments described above, the image formation device is described as having a corona charger, but the corona charger can be omitted.

EXAMPLES

[A1] Manufacturing of the Liquid Developer

The liquid developer was manufactured in the manner described below. Steps for which a temperature is not noted were performed at room temperature (25° C.).

Example A1

Wet Pulverization Step

First, 80 parts by weight of a polyester resin (acid value: 10 mg KOH/g; glass transition temperature (Tg): 55° C.; softening temperature: 107° C.) and 20 parts by weight of a rosin-modified maleic resin (trade name "Markid No. 1," manufactured by Arakawa Chemical Industries, Ltd.; acid value: 25 mg KOH/g or less; softening point: 120° C. or higher and 130° C. or lower; weight-average molecular weight: 3,100) were prepared as resin materials.

A mixture (50:50 mass ratio) of the above resin materials and pigment yellow 180 (manufactured by Clariant) as a colorant was then prepared. These components were mixed using a 20 L Henschel mixer to obtain a starting material for toner manufacturing. This starting material (mixture) was then kneaded using a twin-screw kneading extruder. The kneaded product extruded from the extrusion port of the twin-screw kneading extruder was cooled. The kneaded product cooled as described above was coarsely pulverized to obtain a colorant master batch having an average particle diameter of 1.0 mm or less. A hammer mill was used to coarsely pulverize the kneaded product.

The coarse pulverized product obtained by the method described above, an acrylic-modified silicone (FA40021D, manufactured by Toray Dow Corning) as substance A, aminopropyl phenyl trimethycone (2-2078 Fluid, manufactured by Toray Dow Corning) as substance B, and dimethyl silicone oil (KF-96, manufactured by Shin-Etsu Chemical Co., Ltd.; 50 cs) as a liquid insulator were placed in a ceramic pot (internal volume: 600 mL), zirconia balls (ball diameter: 10 mm) were further placed in the ceramic pot to give a volume fill ratio of 40%, and wet pulverization was carried out in a tabletop pot mill for 48 hours at a rotation speed of 230 rpm. The average roundness $R_0$ of the particles included in the dispersion obtained by the present step was measured as 0.860.

Heating Step

The dispersion obtained by the wet pulverization step was transferred to a beaker which was placed on a hot stirrer and heated to 60° C. A shear of 500 rpm was applied at this time, and heat treatment was carried out for 30 minutes. The dispersion was then allowed to cool to room temperature. The average roundness $R_1$ of the particles included in the dispersion after the present step was 0.905.

Mixing Step

Then, 10 parts by weight of a silanol-containing polysiloxane (DC593, manufactured by Toray Dow Corning) as substance C was added to the dispersion heat-treated as described above, and a liquid developer was obtained by mixing and stirring in a Dispermill. The viscosity of the resultant liquid developer at 25° C. was 450 mPa·s. The volume-average particle diameter ($D_{50}$) of the toner particles was 3.0 μm. The viscosity of the liquid developer at 25° C. was calculated at a shear rate of 0.6 $sec^{-1}$ using an E-type viscometer.

Examples A2 Through A9

Liquid developers were manufactured in the same manner as in Example A1 except that the materials used to manufacture the liquid developers were changed and the heat treatment conditions in the heating step were changed as shown in Table 1.

Example A10

Wet Pulverization Step

First, 85 parts by weight of a polyester resin (acid value: 10 mg KOH/g; glass transition temperature (Tg): 55° C.; softening temperature: 107° C.) and 15 parts by weight of a rosin-modified maleic resin (trade name "Markid No. 1," manufactured by Arakawa Chemical Industries, Ltd.; acid value: 25 mg KOH/g or less; softening point: 120° C. or higher and 130° C. or lower; weight-average molecular weight: 3,100) were prepared as resin materials.

A mixture (50:50 mass ratio) of the above resin materials and pigment yellow 180 (manufactured by Clariant) as a colorant was then prepared. These components were mixed using a 20 L Henschel mixer to obtain a starting material for toner manufacturing. This starting material (mixture) was then kneaded using a twin-screw kneading extruder. The kneaded product extruded from the extrusion port of the twin-screw kneading extruder was cooled. The kneaded product cooled as described above was coarsely pulverized to obtain a colorant master batch having an average particle diameter of 1.0 mm or less. A hammer mill was used to coarsely pulverize the kneaded product.

The coarse pulverized product obtained by the method described above, an acrylic-modified silicone (FA40021D, manufactured by Toray Dow Corning) as substance A, aminopropyl phenyl trimethycone (2-2078 Fluid, manufactured by Toray Dow Corning) as substance B, a silanol-containing polysiloxane (DC593, manufactured by Toray Dow Corning) as substance C, and dimethyl silicone oil (KF-96, manufactured by Shin-Etsu Chemical Co., Ltd.; 50 cs) as a liquid insulator were placed in a ceramic pot (internal volume: 600 mL), zirconia balls (ball diameter: 10 mm) were further placed in the ceramic pot to give a volume fill ratio of 40%, and wet pulverization was carried out in a tabletop pot mill for 48 hours at a rotation speed of 230 rpm. The average roundness $R_0$ of the particles included in the dispersion obtained by the present step was measured as 0.860 through use of an FPIA-3000S.

Heating Step

The dispersion obtained by the wet pulverization step was transferred to a beaker which was placed on a hot stirrer and heated to 60° C. A shear of 500 rpm was applied at this time, and heat treatment was carried out for 30 minutes. The dispersion was then allowed to cool to room temperature and a liquid developer was obtained. The average roundness $R_1$ of the particles included in the obtained liquid developer was 0.912. The viscosity of the resultant liquid developer at 25° C. was 650 mPa·s. The volume-average particle diameter ($D_{50}$) of the toner particles was 2.9 μm. The viscosity of the liquid developer at 25° C. was calculated at a shear rate of 0.6 $sec^{-1}$ using an E-type viscometer.

Comparative Example A1

A liquid developer was manufactured in the same manner as in Example A1 except that substance A was not used in the wet pulverization step, and the amounts of each component shown in Table 1 were used.

Comparative Example A2

A liquid developer was manufactured in the same manner as in Example A1 except that substance B was not used in the wet pulverization step, and the amounts of each component shown in Table 1 were used.

Comparative Example A3

A liquid developer was manufactured in the same manner as in Example A 1 except that substance A substance B were not used in the wet pulverization step, and the amounts of each component shown in Table 1 were used.

Comparative Example A4

A liquid developer was manufactured in the same manner as in Example A1 except that the heating step was omitted.

Comparative Example A5

A liquid developer was manufactured in the same manner as in Example A 1 except that the mixing step was omitted and the amounts of each component shown in Table 1 were used.

Comparative Example A6

A liquid developer was manufactured in the same manner as in Example A1 except that stainless steel balls (diameter: 10 mm) were used instead of zirconia balls, and the volume fill ratio of the stainless steel balls was 20%.

The compositions and manufacturing conditions for the liquid developers of each example and comparative example are summarized in Table 1. Roundness in each example and comparative example was measured as described below. Specifically, for each example and comparative example, a diluted solution was obtained by adding silicone oil (viscosity: 2 cst) to the obtained dispersion and liquid developer to obtain a dilution factor of 1,000 based on volume, and performing ultrasonic dispersion for one minute. Roundness was measured for the resultant diluted solution through use of an FPIA-3000S flow-type particle size distribution analyzer (manufactured by Sysmex). In the table, the polyester resin (acid value: 10 mg KOH/g; glass transition temperature: 55° C., softening point: 107° C.) is indicated as PES1, the rosin-modified maleic resin (trade name "Markid No. 1," manufactured by Arakawa Chemical Industries, Ltd.; acid value: 25 mg KOH/g or less; softening point: 120° C. or higher and 130° C. or lower; weight-average molecular weight: 3,100) as RM1, the rosin-modified polyester resin (trade name "TFS-015," manufactured by Arakawa Chemical Industries, Ltd.; acid value: 11.8 mg KOH/g or less; softening point: 79° C.; weight-average molecular weight: 1,300) as RPES1, the rosin-modified polyester resin (trade name "Trafix 4102," manufactured by Arakawa Chemical Industries, Ltd.; acid value: 15 mg KOH/g or less; softening point: 98° C. or higher and 104° C. or lower; weight-average molecular weight: 1,600) as RPES2, the rosin-modified phenol resin (trade name "Tamanor 135," manufactured by Arakawa Chemical Industries, Ltd.; acid value: 18 mg KOH/g or less; softening point: 130° C. or higher and 140° C. or lower; weight-average molecular weight: 15,000) as RPH1, the acrylic-modified silicone (FA40021D, manufactured by Toray Dow Corning) of substance A as A1, the acrylic-modified silicone (KP575, manufactured by Shin-Etsu Chemical Co., Ltd.) of substance A as A2, the aminopropyl phenyl trimethycone (2-2078 Fluid, manufactured by Toray Dow Corning) of substance B as B1, the quaternary cationic silicone (SilsenseQ-Plus, manufactured by Lubrizol Corporation) of substance B as B2, the phenyl-modified silicone (SH556, manufactured by Toray Dow Corning) of substance B as B3, the phenyl-modified silicone (Silshine-151, manufactured by Momentive) of substance B as B4, the phenyl-modified silicone (PH155, manufactured by Toray Dow Corning) of substance B as B5, the tetra(trimethylsiloxy)silane (DC593, manufactured by Toray Dow Corning) of substance C as C1, the trimethylsiloxy silicate (SS4230, manufactured by Momentive) of substance C as C2, the dimethyl silicone oil (KF-96, manufactured by Shin-Etsu Chemical Co., Ltd.) as KF96, and the dimethyl silicone oil (KF-96-50cs, manufactured by Shin-Etsu Chemical Co., Ltd.) as KF-96-50cs. Also, the tetra(trimethylsiloxy) silane (DC593, manufactured by Toray Dow Corning) and the trimethylsiloxy silicate (SS4230, manufactured by Momentive) are silanol-containing polysiloxanes composed of M units and Q units.

TABLE 1

| | Composition of liquid developer | | | | | | | | | |
|---|---|---|---|---|---|---|---|---|---|---|
| | Parent toner particles | | | | | | | | | |
| | Resin material | | | Colorant | Liquid insulator | | Substance A | | Substance B | |
| | Type | Content (parts by weight) | Tg (° C.) | Content (parts by weight) | Type | Content (parts by weight) | Type | Content (parts by weight) | Type | Content (parts by weight) |
| Example A1 | PES1/RM1 | 20 | 55 | 15 | KF-96 | 74.1 | A1 | 3 | B1 | 0.4 |
| Example A2 | PES1/RM1 | 20 | 55 | 15 | KF-96 | 74.4 | Al | 3 | B2 | 0.1 |
| Example A3 | PES1/RM1 | 20 | 55 | 15 | KF-96 | 74.1 | A1 | 3 | B3 + B5 | 0.4 |
| Example A4 | PES1/RPES1 | 20 | 57 | 15 | KF-96 | 74.1 | A1 | 3 | B1 | 0.4 |
| Example A5 | PES1/RPES2 | 20 | 57 | 15 | KF-96 | 74.1 | A1 | 3 | B1 | 0.4 |
| Example A6 | PES1/RPH1 | 20 | 56 | 15 | KF-96 | 74.1 | A1 | 3 | B1 | 0.4 |
| Example A7 | PES1/RM1 | 20 | 56 | 15 | KF-96 | 74.1 | A2 | 3 | B1 | 0.4 |
| Example A8 | PES1/RM1 | 20 | 57 | 15 | KF-96 | 74.1 | A1 | 3 | B4 | 0.4 |
| Example A9 | PES1/RM1 | 20 | 57 | 15 | KF-96 | 74.1 | A1 | 3 | B1 | 0.4 |
| Example A10 | PES1/RM1 | 20 | 57 | 15 | KF-96 | 74.1 | A1 | 3 | B1 | 0.4 |
| Comparative Example A1 | PES1/RM1 | 20 | 55 | 15 | KF-96 | 77.1 | — | — | B1 | 0.4 |
| Comparative Example A2 | PES1/RM1 | 20 | 55 | 15 | KF-96 | 74.1 | A1 | 3.4 | — | — |
| Comparative Example A3 | PES1/RM1 | 20 | 55 | 15 | KF-96 | 74.1 | — | — | — | — |
| Comparative Example A4 | PES1/RM1 | 20 | 55 | 15 | KF-96 | 74.4 | A1 | 3 | B1 | 0.1 |
| Comparative Example A5 | PES1/RM1 | 20 | 55 | 15 | KF-96 | 74.1 | A1 | 5.5 | B1 | 0.4 |
| Comparative Example A6 | PES1/RM1 | 20 | 55 | 15 | KF-96 | 74.1 | A1 | 3 | B1 | 0.4 |

| | Composition of liquid developer Substance C | | Liquid | Heat treatment conditions | | | | |
|---|---|---|---|---|---|---|---|---|
| | Type | Content (parts by weight) | developer viscosity (mPa · s) | Heating temperature (° C.) | Heating time (minutes) | Speed (rmp) | $R_0$ | $R_1$ |
| Example A1 | C1 | 2.5 | 450 | 60 | 30 | 500 | 0.860 | 0.905 |
| Example A2 | C1 | 2.5 | 650 | 60 | 30 | 500 | 0.860 | 0.908 |
| Example A3 | C1 | 2.5 | 900 | 60 | 30 | 500 | 0.865 | 0.909 |
| Example A4 | C1 | 2.5 | 880 | 60 | 30 | 500 | 0.862 | 0.908 |
| Example A5 | C1 | 2.5 | 950 | 60 | 30 | 500 | 0.857 | 0.901 |
| Example A6 | C1 | 2.5 | 850 | 60 | 30 | 500 | 0.850 | 0.900 |
| Example A7 | C1 | 2.5 | 1020 | 60 | 30 | 500 | 0.866 | 0.912 |
| Example A8 | C1 | 2.5 | 800 | 60 | 30 | 500 | 0.855 | 0.912 |
| Example A9 | C2 | 2.5 | 500 | 60 | 30 | 500 | 0.854 | 0.916 |
| Example A10 | C1 | 2.5 | 650 | 60 | 30 | 500 | 0.860 | 0.912 |
| Comparative Example A1 | C1 | 2.5 | 5000 | 60 | 30 | 500 | 0.839 | 0.920 |
| Comparative Example A2 | C1 | 2.5 | 600 | 60 | 30 | 500 | 0.855 | 0.908 |
| Comparative Example A3 | C1 | 5.9 | 8000 | 60 | 30 | 500 | 0.840 | 0.930 |
| Comparative Example A4 | C1 | 2.5 | 1100 | — | — | — | 0.855 | 0.855 |
| Comparative Example A5 | — | — | 1500 | 60 | 30 | 500 | 0.851 | 0.905 |

TABLE 1-continued

| | | | | | | | | |
|---|---|---|---|---|---|---|---|---|
| Comparative Example A6 | C1 | 2.5 | 450 | 60 | 30 | 500 | 0.780 | 0.870 |

[A2] Evaluation

The liquid developers obtained as described above were evaluated as described below.

[A2.1] Development Efficiency

Using an image formation device such as the one shown in FIGS. 1 and 2, a liquid developer layer of the liquid developer obtained in each example and comparative example was formed on a development roller of the image formation device. The surface potential of the development roller was then set to 300 V, the surface potential of a photoreceptor was uniformly charged to 500 V, the photoreceptor was exposed, and the charge on the photoreceptor surface was attenuated to obtain a surface potential of 50 V. After the liquid developer layer passed between the photoreceptor and the development roller, the toner particles on the development roller and the toner particles on the photoreceptor were collected using tape. Each tape used for collection was affixed to a recording paper, and the concentration of each set of toner particles was measured. After measurement, the development efficiency was calculated by multiplying 100 by the number obtained by dividing the concentration of the toner particles collected from the photoreceptor by the sum of the concentration of the toner particles collected from the photoreceptor and the concentration of the toner particles collected from the development roller, and the development efficiency was evaluated according to the four levels shown below.

A: Development efficiency of 97% or higher; particularly excellent.

B: Development efficiency of 92% or higher but less than 97%; excellent.

C: Development efficiency of 80% or higher but less than 92%; no practical problems.

D: Development efficiency of less than 80%; inferior.

[A2.2] Transfer Efficiency

Using an image formation device such as the one shown in FIGS. 1 and 2, a liquid developer layer of the liquid developer obtained in each example and comparative example was formed on a photoreceptor of the image formation device. After the liquid developer layer passed between the photoreceptor and the intermediate transfer part, the toner particles on the photoreceptor and the toner particles on the intermediate transfer part were collected using tape. Each tape used for collection was affixed to a recording paper, and the concentration of each set of toner particles was measured. After measurement, the transfer efficiency was calculated by multiplying 100 by the number obtained by dividing the concentration of the toner particles collected from the intermediate transfer part by the sum of the concentration of the toner particles collected from the photoreceptor and the concentration of the toner particles collected from the intermediate transfer part, and the transfer efficiency was evaluated according to the four levels shown below.

A: Transfer efficiency of 97% or higher; particularly excellent.

B: Transfer efficiency of 92% or higher but less than 97%; excellent.

C: Transfer efficiency of 80% or higher but less than 92%; no practical problems.

D: Transfer efficiency of less than 80%; inferior.

[A2.3] Fixing Strength

Using an image formation device such as the one shown in FIGS. 1 and 2, an image of a predetermined pattern was formed on a recording paper (LPCPPA4 high-quality paper, manufactured by Seiko Epson) by the liquid developer obtained in each example and comparative example. Heat fixing was then performed at a set temperature of 100° C. After a non-offset region was confirmed, the fixed image on the recording paper was rubbed twice using a rubber eraser (Lion 261-11 sand texture eraser, manufactured by Lion Office Products Corp.) with a pressure load of 1.2 kgf, and the residual ratio of image density was measured using an X-Rite model 404 manufactured by X-Rite, Inc. and evaluated according to the five levels shown below.

A: Residual image density of 96% or higher (extremely good).

B: Residual image density of 90% or higher but less than 96% (good).

C: Residual image density of 80% or higher but less than 90% (normal).

D: Residual image density of 70% or higher but less than 80% (somewhat poor).

E: Residual image density of less than 70% (extremely poor).

[A2.4] Positive Charging Characteristics

The potential difference for the liquid developer obtained in each example and comparative example was measured using a ZC-2000 "microscope laser zeta potentiometer" manufactured by Microtec Nition Corporation, and evaluated according to the five levels shown below. In the measurement, the liquid developer was diluted with a dilution medium and placed in a 10 mm transparent cell, and by observing the movement speed of the particles in the cell under a microscope while applying a voltage of 300 V across electrodes 9 mm apart, the movement speed was computed, and the zeta potential was calculated from this value.

A: Potential difference of +100 mV or greater (extremely good).

B: Potential difference of +85 mV or greater but less than +100 mV (good).

C: Potential difference of 70 mV or greater but less than +85 mV (normal).

D: Potential difference of 50 mV or greater but less than +70 mV (somewhat poor).

E: Potential difference of less than +50 mV (extremely poor).

[A2.5] Dispersion Stability Test

[A2.5.1] Method 1

An amount of 10 mL of the liquid developer obtained in each example and comparative example was placed in a test tube (mouth diameter: 12 mm, length: 120 mm), the depth of precipitation was measured after standing for 10 days, and evaluation was made according to the four levels shown below.

A: Precipitated depth of 0 mm.

B: Precipitated depth greater than 0 mm, and 2 mm or less.

C: Precipitated depth greater than 2 mm, and 5 mm or less.

D: Precipitated depth greater than 5 mm.

[A2.5.2] Method 2

An amount of 45.5 mL of the liquid developer obtained in each example and comparative example was placed in a centrifuge tube, and after the tube was placed in a centrifuge (manufactured by Kokusan Co., Ltd.) for three minutes at speeds of 500, 1000, 2000, 4000, and 5000 rpm at a rotation radius of 5 cm, the precipitated depth for each speed was measured. The measured results were plotted with the centrifugal acceleration $r\omega^2$ ($r\omega^2$=1118×rotation radius (cm)×per-minute speed (rpm)$^2$×$10^{-8}$ g (gravitational acceleration)) on the horizontal axis and the precipitated depth on the vertical axis. The slope k was calculated by primary approximation based on each plot, and evaluation was made according to the criteria shown below. The lower the value of k, the higher the dispersion stability.

A: $0 \leq k < 0.004$

B: $0.004 \leq k < 0.008$

C: $0.008 \leq k < 0.012$

D: $k \geq 0.012$

[A2.6] Recyclability

An image of a predetermined pattern was formed on 10,000 sheets of recording paper (LPCPPA4 high-quality paper, manufactured by Seiko Epson) by an image formation device such as the one shown in FIGS. 1 and 2 using the liquid developer obtained in each example and comparative example. This image formation was performed in a state in which feeding of the liquid developer from the liquid developer tank of each color to the stirring device of each corresponding color was stopped. After images were formed on 10,000 sheets of recording paper, testing was performed by two types of methods (Method 1, Method 2) such as described below for the liquid developer (recycled liquid developer) regenerated by diluting the toner particles recovered by the stirring devices with the liquid insulator to give a solids content ratio of 20% by mass, and the adaptability (recycling properties) of recycling was evaluated.

[A2.6.1] Method 1

An amount of 10 mL of the recycled liquid developer for each example and comparative example was placed in a test tube (mouth diameter: 12 mm, length: 120 mm), the depth of precipitation was measured after standing for 14 days, and evaluation was made according to the four levels shown below.

A: Precipitated depth of 1 mm or less.

B: Precipitated depth greater than 1 mm, and 3 mm or less.

C: Precipitated depth greater than 3 mm, and 6 mm or less.

D: Precipitated depth greater than 6 mm.

[A2.6.2] Method 2

An amount of 45.5 mL of the recycled liquid developer obtained for each example and comparative example was placed in a centrifuge tube, and after the tube was placed in a centrifuge (manufactured by Kokusan Co., Ltd.) for five minutes at speeds of 500, 1000, 2000, 4000, and 5000 rpm at a rotation radius of 5 cm, the precipitated depth for each speed was measured. The measured results were plotted with the centrifugal acceleration $r\omega^2$ ($r\omega^2$=1118×rotation radius (cm)×per-minute speed (rpm)$^2$×$10^{-8}$ g (gravitational acceleration)) on the horizontal axis and the precipitated depth on the vertical axis. The slope k was calculated by primary approximation based on each plot, and evaluation was made according to the criteria shown below. The lower the value of k, the higher the dispersion stability.

A: $0 \leq k < 0.006$

B: $0.006 \leq k < 0.010$

C: $0.010 \leq k < 0.014$

D: $k \geq 0.014$

These results are shown in Table 2.

TABLE 2

| | Development efficiency | Transfer efficiency | Fixing strength | Positive charging characteristics | Dispersion stability | | Recyclability | |
|---|---|---|---|---|---|---|---|---|
| | | | | | Method 1 | Method 2 | Method 1 | Method 2 |
| Example A1 | A | A | A | A | A | A | A | A |
| Example A2 | A | A | A | B | A | A | A | A |
| Example A3 | B | A | A | B | A | A | A | A |
| Example A4 | A | A | A | A | A | A | A | A |
| Example A5 | A | A | A | A | A | A | A | A |
| Example A6 | A | A | A | A | A | A | A | A |
| Example A7 | B | B | A | B | B | B | B | B |
| Example A8 | B | B | A | B | B | B | B | B |
| Example A9 | B | B | A | B | A | A | A | A |
| Example A10 | A | A | A | A | A | A | A | A |
| Comparative Example A1 | C | C | B | C | D | D | D | D |
| Comparative Example A2 | C | C | B | C | C | C | C | C |
| Comparative Example A3 | D | D | B | D | D | D | D | D |
| Comparative Example A4 | D | D | B | D | C | C | C | C |
| Comparative Example A5 | D | D | B | D | D | D | D | D |
| Comparative Example A6 | D | D | B | D | D | D | D | D |

As is apparent from Table 2, the liquid developer of the invention has excellent charging characteristics (positive charging characteristics). The liquid developer of the invention also has excellent recyclability and long-term dispersion stability of the toner particles. The liquid developer of the invention also has excellent development efficiency, transfer efficiency, and fixing strength. In contrast, satisfactory results were not obtained from the liquid developers of the comparative examples.

[B1] Manufacture of the Liquid Developer

The liquid developer was manufactured as described below. Steps for which a temperature is not noted were performed at room temperature (25° C.).

Example B1

Wet Pulverization Step

First, 80 parts by weight of a polyester resin (acid value: 10 mg KOH/g; glass transition temperature (Tg): 55° C.; softening temperature: 107° C.) and 20 parts by weight of a rosin-modified maleic resin (trade name "Markid No. 1," manufactured by Arakawa Chemical Industries, Ltd.; acid value: 25 mg KOH/g or less; softening point: 120° C. or higher and 130° C. or lower; weight-average molecular weight: 3,100) were prepared as resin materials.

A mixture (50:50 mass ratio) of the above resin materials and pigment yellow 180 (manufactured by Clariant) as a colorant was then prepared. These components were mixed using a 20 L Henschel mixer to obtain a starting material for toner manufacturing. This starting material (mixture) was then kneaded using a twin-screw kneading extruder. The kneaded product extruded from the extrusion port of the twin-screw kneading extruder was cooled. The kneaded product cooled as described above was coarsely pulverized to obtain a colorant master batch having an average particle diameter of 1.0 mm or less. A hammer mill was used to coarsely pulverize the kneaded product.

The coarse pulverized product obtained by the method described above, an acrylic-modified silicone (FA40021D, manufactured by Toray Dow Corning) as substance A, aminopropyl phenyl trimethycone (2-2078 Fluid, manufactured by Toray Dow Corning) as substance B, and dimethyl silicone oil (KF-96, manufactured by Shin-Etsu Chemical Co., Ltd.; 50 cs) as a liquid insulator were placed in a ceramic pot (internal volume: 600 mL), zirconia balls (ball diameter: 10 mm) were further placed in the ceramic pot to give a volume fill ratio of 40%, and wet pulverization was carried out in a tabletop pot mill for 48 hours at a rotation speed of 230 rpm. The average roundness $R_0$ of the particles included in the dispersion obtained by the present step was measured as 0.860.

Heating Step

The dispersion obtained by the wet pulverization step was transferred to a beaker which was placed on a hot stirrer and heated to 60° C. A shear of 500 rpm was applied at this time, and heat treatment was carried out for 30 minutes. The dispersion was then allowed to cool to room temperature. The average roundness $R_1$ of the particles included in the dispersion after the present step was 0.905.

Mixing Step

Then, 10 parts by weight of a fluorine-modified silicone (XS66-B8226, manufactured by Momentive) as substance C was added to the dispersion heat-treated as described above, and a liquid developer was obtained by mixing and stirring in a Dispermill. The viscosity of the resultant liquid developer at 25° C. was 450 mPa·s. The volume-average particle diameter ($D_{50}$) of the toner particles was 3.0 μm. The viscosity of the liquid developer at 25° C. was calculated at a shear rate of 0.6 $sec^{-1}$ using an E-type viscometer.

Examples B2 Through B9

Liquid developers were manufactured in the same manner as in Example B1 except that the materials used to manufacture the liquid developers were changed and the heat treatment conditions in the heating step were changed as shown in Table 3.

Example B10

Wet Pulverization Step

First, 85 parts by weight of a polyester resin (acid value: 10 mg KOH/g; glass transition temperature (Tg): 55° C.; softening temperature: 107° C.) and 15 parts by weight of a rosin-modified maleic resin (trade name "Markid No. 1," manufactured by Arakawa Chemical Industries, Ltd.; acid value: 25 mg KOH/g or less; softening point: 120° C. or higher and 130° C. or lower; weight-average molecular weight: 3,100) were prepared as resin materials.

A mixture (50:50 mass ratio) of the above resin materials and pigment yellow 180 (manufactured by Clariant) as a colorant was then prepared. These components were mixed using a 20 L Henschel mixer to obtain a starting material for toner manufacturing. This starting material (mixture) was then kneaded using a twin-screw kneading extruder. The kneaded product extruded from the extrusion port of the twin-screw kneading extruder was cooled. The kneaded product cooled as described above was coarsely pulverized to obtain a colorant master batch having an average particle diameter of 1.0 mm or less. A hammer mill was used to coarsely pulverize the kneaded product.

The coarse pulverized product obtained by the method described above, an acrylic-modified silicone (FA40021D, manufactured by Toray Dow Corning) as substance A, aminopropyl phenyl trimethycone (2-2078 Fluid, manufactured by Toray Dow Corning) as substance B, a fluorine-modified silicone (XS66-B8226, manufactured by Momentive) as substance C, and dimethyl silicone oil (KF-96, manufactured by Shin-Etsu Chemical Co., Ltd.; 50 cs) as a liquid insulator were placed in a ceramic pot (internal volume: 600 mL), zirconia balls (ball diameter: 10 mm) were further placed in the ceramic pot to give a volume fill ratio of 40%, and wet pulverization was carried out in a tabletop pot mill for 48 hours at a rotation speed of 230 rpm. The average roundness $R_0$ of the particles included in the dispersion obtained by the present step was measured as 0.860 through use of an FPIA-3000S.

Heating Step

The dispersion obtained by the wet pulverization step was transferred to a beaker which was placed on a hot stirrer and heated to 60° C. A shear of 500 rpm was applied at this time, and heat treatment was carried out for 30 minutes. The dispersion was then allowed to cool to room temperature and a liquid developer was obtained. The average roundness $R_1$ of the particles included in the obtained liquid developer was 0.912. The viscosity of the resultant liquid developer at 25° C. was 650 mPa·s. The volume-average particle diameter ($D_{50}$) of the toner particles was 2.9 μm. The viscosity of the liquid developer at 25° C. was calculated at a shear rate of 0.6 $sec^{-1}$ using an E-type viscometer.

Comparative Example B1

A liquid developer was manufactured in the same manner as in Example B1 except that substance A was not used in the wet pulverization step, and the amounts of each component shown in Table 3 were used.

Comparative Example B2

A liquid developer was manufactured in the same manner as in Example B1 except that substance B was not used in the wet pulverization step, and the amounts of each component shown in Table 3 were used.

Comparative Example B3

A liquid developer was manufactured in the same manner as in Example B1 except that substance A substance B were not used in the wet pulverization step, and the amounts of each component shown in Table 3 were used.

Comparative Example B4

A liquid developer was manufactured in the same manner as in Example B1 except that the heating step was omitted.

Comparative Example B5

A liquid developer was manufactured in the same manner as in Example 1 except that the mixing step was omitted and the amounts of each component shown in Table 3 were used.

Comparative Example B6

A liquid developer was manufactured in the same manner as in Example B1 except that stainless steel balls (diameter: 10 mm) were used instead of zirconia balls, and the volume fill ratio of the stainless steel balls was 20%.

The compositions and manufacturing conditions for the liquid developers of each example and comparative example are summarized in Table 3. Roundness in each example and comparative example was measured as described below. Specifically, for each example and comparative example, a diluted solution was obtained by adding silicone oil (viscosity: 2 cst) to the obtained dispersion and liquid developer to obtain a dilution factor of 1,000 based on volume, and performing ultrasonic dispersion for one minute. Roundness was measured for the resultant diluted solution through use of an FPIA-3000S flow-type particle size distribution analyzer (manufactured by Sysmex). In the table, the polyester resin (acid value: 10 mg KOH/g; glass transition temperature: 55° C., softening point: 107° C.) is indicated as PES1, the rosin-modified maleic resin (trade name "Markid No. 1," manufactured by Arakawa Chemical Industries, Ltd.; acid value: 25 mg KOH/g or less; softening point: 120° C. or higher and 130° C. or lower; weight-average molecular weight: 3,100) as RM1, the rosin-modified polyester resin (trade name "TFS-015," manufactured by Arakawa Chemical Industries, Ltd.; acid value: 11.8 mg KOH/g or less; softening point: 79° C.; weight-average molecular weight: 1,300) as RPES1, the rosin-modified polyester resin (trade name "Trafix 4102," manufactured by Arakawa Chemical Industries, Ltd.; acid value: 15 mg KOH/g or less; softening point: 98° C. or higher and 104° C. or lower; weight-average molecular weight: 1,600) as RPES2, the rosin-modified phenol resin (trade name "Tamanor 135," manufactured by Arakawa Chemical Industries, Ltd.; acid value: 18 mg KOH/g or less; softening point: 130° C. or higher and 140° C. or lower; weight-average molecular weight: 15,000) as RPH1, the acrylic-modified silicone (FA40021D, manufactured by Toray Dow Corning) of substance A as A1, the acrylic-modified silicone (KP575, manufactured by Shin-Etsu Chemical Co., Ltd.) of substance A as A2, the aminopropyl phenyl trimethycone (2-2078 Fluid, manufactured by Toray Dow Corning) of substance B as B1, the quaternary cationic silicone (SilsenseQ-Plus, manufactured by Lubrizol Corporation) of substance B as B2, the phenyl-modified silicone (SH556, manufactured by Toray Dow Corning) of substance B as B3, the phenyl-modified silicone (Silshine-151, manufactured by Momentive) of substance B as B4, the phenyl-modified silicone (PH1555, manufactured by Toray Dow Corning) of substance B as B5, the fluoro-modified silicone (XS66-B8226, manufactured by Momentive) of substance C as C3, the fluoro-modified silicone (XS66-C1191, manufactured by Momentive) of substance C as C4, the fluoro-modified silicone (XS66-B8636, manufactured by Momentive) of substance C as C5, the dimethyl silicone oil (KF-96, manufactured by Shin-Etsu Chemical Co., Ltd.) as KF96, and the dimethyl silicone oil (KF-96-50cs, manufactured by Shin-Etsu Chemical Co., Ltd.) as KF-96-50cs. Also, the fluoro-modified silicone (XS66-B8226, manufactured by Momentive), the fluoro-modified silicone (XS66-C1191, manufactured by Momentive), and the fluoro-modified silicone (XS66-B8636, manufactured by Momentive) are fluorine-modified silicones composed of M units and Q units.

TABLE 3

| | Composition of liquid developer | | | | | | | | | |
|---|---|---|---|---|---|---|---|---|---|---|
| | Parent toner particles | | | | | | | | | |
| | Resin material | | | Colorant | Liquid insulator | | Substance A | | Substance B | |
| | Type | Content (parts by weight) | Tg (° C.) | Content (parts by weight) | Type | Content (parts by weight) | Type | Content (parts by weight) | Type | Content (parts by weight) |
| Example B1 | PES1/RM1 | 20.0 | 55 | 15.0 | KF-96 | 74.1 | A1 | 3.0 | B1 | 0.4 |
| Example B2 | PES1/RM1 | 20.0 | 55 | 15.0 | KF-96 | 74.4 | A1 | 3.0 | B2 | 0.1 |
| Example B3 | PES1/RM1 | 20.0 | 55 | 15.0 | KF-96 | 74.1 | A1 | 3.0 | B3 + B5 | 0.4 |
| Example B4 | PES1/RPES1 | 20.0 | 57 | 15.0 | KF-96 | 74.1 | A1 | 3.0 | B1 | 0.4 |
| Example B5 | PES1/RPES2 | 20.0 | 57 | 15.0 | KF-96 | 74.1 | A1 | 3.0 | B1 | 0.4 |
| Example B6 | PES1/RPH1 | 20.0 | 56 | 15.0 | KF-96 | 74.1 | A1 | 3.0 | B1 | 0.4 |
| Example B7 | PES1/RM1 | 20.0 | 56 | 15.0 | KF-96 | 74.1 | A2 | 3.0 | B1 | 0.4 |
| Example B8 | PES1/RM1 | 20.0 | 57 | 15.0 | KF-96 | 74.1 | A1 | 3.0 | B4 | 0.4 |
| Example B9 | PES1/RM1 | 20.0 | 57 | 15.0 | KF-96 | 74.1 | A1 | 3.0 | B1 | 0.4 |
| Example B10 | PES1/RM1 | 20.0 | 57 | 15.0 | KF-96 | 74.1 | A1 | 3.0 | B1 | 0.4 |
| Comparative Example B1 | PES1/RM1 | 20.0 | 55 | 15.0 | KF-96 | 77.1 | — | — | B1 | 0.4 |
| Comparative Example B2 | PES1/RM1 | 20.0 | 55 | 15.0 | KF-96 | 74.1 | A1 | 3.4 | — | — |
| Comparative Example B3 | PES1/RM1 | 20.0 | 55 | 15.0 | KF-96 | 74.1 | — | — | — | — |
| Comparative Example B4 | PES1/RM1 | 20.0 | 55 | 15.0 | KF-96 | 74.4 | A1 | 3.0 | B1 | 0.1 |
| Comparative Example B5 | PES1/RM1 | 20.0 | 55 | 15.0 | KF-96 | 74.1 | A1 | 5.5 | B1 | 0.4 |
| Comparative Example B6 | PES1/RM1 | 20.0 | 55 | 15.0 | KF-96 | 74.1 | A1 | 3.0 | B1 | 0.4 |

TABLE 3-continued

| | Composition of liquid developer Substance C | | Liquid | Heat treatment conditions | | | | |
|---|---|---|---|---|---|---|---|---|
| | Type | Content (parts by weight) | developer viscosity (mPa · s) | Heating temperature (° C.) | Heating time (minutes) | Speed (rmp) | $R_0$ | $R_1$ |
| Example B1 | C3 | 2.5 | 450 | 60 | 30 | 500 | 0.860 | 0.905 |
| Example B2 | C3 | 2.5 | 650 | 60 | 30 | 500 | 0.860 | 0.908 |
| Example B3 | C5 | 2.5 | 900 | 60 | 30 | 500 | 0.865 | 0.909 |
| Example B4 | C3 | 2.5 | 880 | 60 | 30 | 500 | 0.862 | 0.908 |
| Example B5 | C3 | 2.5 | 950 | 60 | 30 | 500 | 0.857 | 0.901 |
| Example B6 | C3 | 2.5 | 850 | 60 | 30 | 500 | 0.850 | 0.900 |
| Example B7 | C4 | 2.5 | 1020 | 60 | 30 | 500 | 0.866 | 0.912 |
| Example B8 | C5 | 2.5 | 800 | 60 | 30 | 500 | 0.855 | 0.912 |
| Example B9 | C4 | 2.5 | 500 | 60 | 30 | 500 | 0.854 | 0.916 |
| Example B10 | C3 | 2.5 | 650 | 60 | 30 | 500 | 0.860 | 0.912 |
| Comparative Example B1 | C3 | 2.5 | 5000 | 60 | 30 | 500 | 0.839 | 0.920 |
| Comparative Example B2 | C3 | 2.5 | 600 | 60 | 30 | 500 | 0.855 | 0.908 |
| Comparative Example B3 | C3 | 5.9 | 8000 | 60 | 30 | 500 | 0.840 | 0.930 |
| Comparative Example B4 | C3 | 2.5 | 1100 | — | — | — | 0.855 | 0.855 |
| Comparative Example B5 | — | — | 1500 | 60 | 30 | 500 | 0.851 | 0.905 |
| Comparative Example B6 | C3 | 2.5 | 450 | 60 | 30 | 500 | 0.780 | 0.870 |

[B2] Evaluation

The liquid developers obtained as described above were evaluated as described below.

[B2.1] Development Efficiency

Using an image formation device such as the one shown in FIGS. 1 and 2, a liquid developer layer of the liquid developer obtained in each example and comparative example was formed on a development roller of the image formation device. The surface potential of the development roller was then set to 300 V, the surface potential of a photoreceptor was uniformly charged to 500 V, the photoreceptor was exposed, and the charge on the photoreceptor surface was attenuated to obtain a surface potential of 50 V. After the liquid developer layer passed between the photoreceptor and the development roller, the toner particles on the development roller and the toner particles on the photoreceptor were collected using tape. Each tape used for collection was affixed to a recording paper, and the concentration of each set of toner particles was measured. After measurement, the development efficiency was calculated by multiplying 100 by the number obtained by dividing the concentration of the toner particles collected from the photoreceptor by the sum of the concentration of the toner particles collected from the photoreceptor and the concentration of the toner particles collected from the development roller, and the development efficiency was evaluated according to the four levels shown below.

A: Development efficiency of 97% or higher; particularly excellent.

B: Development efficiency of 92% or higher but less than 97%; excellent.

C: Development efficiency of 80% or higher but less than 92%; no practical problems.

D: Development efficiency of less than 80%; inferior.

[B2.2] Transfer Efficiency

Using an image formation device such as the one shown in FIGS. 1 and 2, a liquid developer layer of the liquid developer obtained in each example and comparative example was formed on a photoreceptor of the image formation device. After the liquid developer layer passed between the photoreceptor and the intermediate transfer part, the toner particles on the photoreceptor and the toner particles on the intermediate transfer part were collected using tape. Each tape used for collection was affixed to a recording paper, and the concentration of each set of toner particles was measured. After measurement, the transfer efficiency was calculated by multiplying 100 by the number obtained by dividing the concentration of the toner particles collected from the intermediate transfer part by the sum of the concentration of the toner particles collected from the photoreceptor and the concentration of the toner particles collected from the intermediate transfer part, and the transfer efficiency was evaluated according to the four levels shown below.

A: Transfer efficiency of 97% or higher; particularly excellent.

B: Transfer efficiency of 92% or higher but less than 97%; excellent.

C: Transfer efficiency of 80% or higher but less than 92%; no practical problems.

D: Transfer efficiency of less than 80%; inferior.

[B2.3] Fixing Strength

Using an image formation device such as the one shown in FIGS. 1 and 2, an image of a predetermined pattern was formed on a recording paper (LPCPPA4 high-quality paper, manufactured by Seiko Epson) by the liquid developer obtained in each example and comparative example. Heat fixing was then performed at a set temperature of 100° C. After a non-offset region was confirmed, the fixed image on the recording paper was rubbed twice using a rubber eraser (Lion 261-11 sand texture eraser, manufactured by Lion Office Products Corp.) with a pressure load of 1.2 kgf, and the residual ratio of image density was measured using an X-Rite model 404 manufactured by X-Rite, Inc. and evaluated according to the five levels shown below.

A: Residual image density of 96% or higher (extremely good).

B: Residual image density of 90% or higher but less than 96% (good).

C: Residual image density of 80% or higher but less than 90% (normal).

D: Residual image density of 70% or higher but less than 80% (somewhat poor).

E: Residual image density of less than 70% (extremely poor).

[B2.4] Positive Charging Characteristics

The potential difference for the liquid developer obtained in each example and comparative example was measured using a ZC-2000 "microscope laser zeta potentiometer" manufactured by Microtec Nition Corporation, and evaluated according to the five levels shown below. In the measurement, the liquid developer was diluted with a dilution medium and placed in a 10 mm transparent cell, and by observing the movement speed of the particles in the cell under a microscope while applying a voltage of 300 V across electrodes 9 mm apart, the movement speed was computed, and the zeta potential was calculated from this value.

A: Potential difference of +100 mV or greater (extremely good).

B: Potential difference of +85 mV or greater but less than +100 mV (good).

C: Potential difference of 70 mV or greater but less than +85 mV (normal).

D: Potential difference of 50 mV or greater but less than +70 mV (somewhat poor).

E: Potential difference of less than +50 mV (extremely poor).

[B2.5] Dispersion Stability Test

[B2.5.1] Method 1

An amount of 10 mL of the liquid developer obtained in each example and comparative example was placed in a test tube (mouth diameter: 12 mm, length: 120 mm), the depth of precipitation was measured after standing for 10 days, and evaluation was made according to the four levels shown below.

A: Precipitated depth of 0 mm.

B: Precipitated depth greater than 0 mm, and 2 mm or less.

C: Precipitated depth greater than 2 mm, and 5 mm or less.

D: Precipitated depth greater than 5 mm.

[B2.5.2] Method 2

An amount of 45.5 mL of the liquid developer obtained in each example and comparative example was placed in a centrifuge tube, and after the tube was placed in a centrifuge (manufactured by Kokusan Co., Ltd.) for three minutes at speeds of 500, 1000, 2000, 4000, and 5000 rpm at a rotation radius of 5 cm, the precipitated depth for each speed was measured. The measured results were plotted with the centrifugal acceleration $r\omega^2$ ($r\omega^2$=1118×rotation radius (cm)×per-minute speed (rpm)$^2$×$10^{-8}$ g (gravitational acceleration)) on the horizontal axis and the precipitated depth on the vertical axis. The slope k was calculated by primary approximation based on each plot, and evaluation was made according to the criteria shown below. The lower the value of k, the higher the dispersion stability.

A: $0 \leq k < 0.004$

B: $0.004 \leq k < 0.008$

C: $0.008 \leq k < 0.012$

D: $k \geq 0.012$

[B2.6] Recyclability

An image of a predetermined pattern was formed on 10,000 sheets of recording paper (LPCPPA4 high-quality paper, manufactured by Seiko Epson) by an image formation device such as the one shown in FIGS. 1 and 2 using the liquid developer obtained in each example and comparative example. This image formation was performed in a state in which feeding of the liquid developer from the liquid developer tank of each color to the stirring device of each corresponding color was stopped. After images were formed on 10,000 sheets of recording paper, testing was performed by two types of methods (Method 1, Method 2) such as described below for the liquid developer (recycled liquid developer) regenerated by diluting the toner particles recovered by the stirring devices with the liquid insulator to give a solids content ratio of 20% by mass, and the adaptability (recycling properties) of recycling was evaluated.

[B2.6.1] Method 1

An amount of 10 mL of the recycled liquid developer for each example and comparative example was placed in a test tube (mouth diameter: 12 mm, length: 120 mm), the depth of precipitation was measured after standing for 14 days, and evaluation was made according to the four levels shown below.

A: Precipitated depth of 1 mm or less.

B: Precipitated depth greater than 1 mm, and 3 mm or less.

C: Precipitated depth greater than 3 mm, and 6 mm or less.

D: Precipitated depth greater than 6 mm.

[B2.6.2] Method 2

An amount of 45.5 mL of the recycled liquid developer obtained for each example and comparative example was placed in a centrifuge tube, and after the tube was placed in a centrifuge (manufactured by Kokusan Co., Ltd.) for five minutes at speeds of 500, 1000, 2000, 4000, and 5000 rpm at a rotation radius of 5 cm, the precipitated depth for each speed was measured. The measured results were plotted with the centrifugal acceleration $r\omega^2$ ($r\omega^2$=1118×rotation radius (cm)×per-minute speed (rpm)$^2$×$10^{-8}$ g (gravitational acceleration)) on the horizontal axis and the precipitated depth on the vertical axis. The slope k was calculated by primary approximation based on each plot, and evaluation was made according to the criteria shown below. The lower the value of k, the higher the dispersion stability.

A: $0 \leq k < 0.006$

B: $0.006 \leq k < 0.010$

C: $0.010 \leq k < 0.014$

D: $k \geq 0.014$

These results are shown in Table 4.

TABLE 4

| | Development efficiency | Transfer efficiency | Fixing strength | Positive charging characteristics | Dispersion stability | | Recyclability | |
|---|---|---|---|---|---|---|---|---|
| | | | | | Method 1 | Method 2 | Method 1 | Method 2 |
| Example B1 | A | A | A | A | A | A | A | A |
| Example B2 | A | A | A | B | A | A | A | A |
| Example B3 | B | A | A | B | A | A | A | A |
| Example B4 | A | A | A | A | A | A | A | A |
| Example B5 | A | A | A | A | A | A | A | A |
| Example B6 | A | A | A | A | A | A | A | A |

TABLE 4-continued

| | Development efficiency | Transfer efficiency | Fixing strength | Positive charging characteristics | Dispersion stability | | Recyclability | |
|---|---|---|---|---|---|---|---|---|
| | | | | | Method 1 | Method 2 | Method 1 | Method 2 |
| Example B7 | B | B | A | B | B | B | B | B |
| Example B8 | B | B | A | B | B | B | B | B |
| Example B9 | B | B | A | B | A | A | A | A |
| Example B10 | A | A | A | A | A | A | A | A |
| Comparative Example B1 | C | C | B | C | D | D | D | D |
| Comparative Example B2 | C | C | B | C | C | C | C | C |
| Comparative Example B3 | D | D | B | D | D | D | D | D |
| Comparative Example B4 | D | D | B | D | C | C | C | C |
| Comparative Example B5 | D | D | B | D | D | D | D | D |
| Comparative Example B6 | D | D | B | D | D | D | D | D |

As is apparent from Table 4, the liquid developer of the invention has excellent charging characteristics (positive charging characteristics). The liquid developer of the invention also has excellent recyclability and long-term dispersion stability of the toner particles. The liquid developer of the invention also has excellent development efficiency, transfer efficiency, and fixing strength. In contrast, satisfactory results were not obtained from the liquid developers of the comparative examples.

[C1] Manufacture of the Liquid Developer

The liquid developer was manufactured as described below. Steps for which a temperature is not noted were performed at room temperature (25° C.).

Example C1

Kneading Step, Coarse Pulverization Step

Preparation of Colorant Master Batch

First, 60 parts by weight of a polyester resin (glass transition temperature (Tg): 55° C.) was prepared as a resin material. A mixture (50:50 mass ratio) of the resin material and a cyan-based pigment (pigment blue 15:3, manufactured by Dainichiseika Color & Chemicals Mfg. Co., Ltd.) as a colorant was then prepared. These components were mixed using a 20 L Henschel mixer to obtain a starting material for toner manufacturing. This starting material (mixture) was then kneaded using a twin-screw kneading extruder. The kneaded product extruded from the extrusion port of the twin-screw kneading extruder was cooled. The kneaded product cooled as described above was coarsely pulverized to obtain a colorant master batch having an average particle diameter of 1.0 mm or less. A hammer mill was used to coarsely pulverize the kneaded product.

Preparation of Coarse Pulverized Product

A twin-screw kneading extruder was used to knead 15 parts by weight of the colorant master batch and 85 parts by weight of the polyester resin. The kneaded product extruded from the extrusion port of the twin-screw kneading extruder was then cooled. The obtained kneaded product was pulverized in a hammer mill to obtain a coarse pulverized product.

Wet Pulverization Step

The coarse pulverized product obtained by the method described above, an acrylic-modified silicone (FA40021D, 40% isodecane solution, manufactured by Toray Dow Corning), aminopropyl phenyl trimethycone (2-2078 Fluid, manufactured by Toray Dow Corning), and dimethyl silicone oil (KF-96, manufactured by Shin-Etsu Chemical Co., Ltd.; 50 cs) as a liquid insulator were placed in a ceramic pot (internal volume: 600 mL), zirconia balls (ball diameter: 10 mm) were further placed in the ceramic pot to give a volume fill ratio of 40%, and wet pulverization was carried out in a tabletop pot mill for 48 hours at a rotation speed of 230 rpm. The average roundness $R_0$ of the particles included in the dispersion obtained by the present step was measured as 0.860.

Heating Step

The dispersion obtained by the wet pulverization step was transferred to a beaker which was placed on a hot stirrer and heated to 60° C. A shear of 500 rpm was applied at this time, and heat treatment was carried out for 30 minutes. The dispersion was then allowed to cool to room temperature. The average roundness $R_1$ of the particles included in the dispersion after the present step was 0.905. Then, 10 parts by weight of a silanol-containing polysiloxane (DC593, manufactured by Toray Dow Corning) was added to the dispersion heat-treated as described above, and a liquid developer was obtained by mixing and stirring in a Dispermill. The volume-average particle diameter ($D_{50}$) of the toner particles was 3.0 μm.

Examples C2 Through C7

Liquid developers were manufactured in the same manner as in Example C1 except that the materials used to manufacture the liquid developers were changed and the heat treatment conditions in the heating step were changed as shown in Table 5.

Example C8

Kneading Step, Coarse Pulverization Step

Preparation of Colorant Master Batch

First, 60 parts by weight of a polyester resin (glass transition temperature (Tg): 55° C.) was prepared as a resin material. A mixture (50:50 mass ratio) of the resin material and a cyan-based pigment (pigment blue 15:3, manufactured by Dainichiseika Color & Chemicals Mfg. Co., Ltd.) as a colorant was then prepared. These components were mixed using a 20 L Henschel mixer to obtain a starting material for toner manufacturing. This starting material (mixture) was then kneaded using a twin-screw kneading extruder. The kneaded product extruded from the extrusion port of the twin-screw kneading extruder was cooled. The kneaded product cooled as described above was coarsely pulverized to obtain a colorant master batch having an average particle diameter of 1.0 mm or less. A hammer mill was used to coarsely pulverize the kneaded product.

Preparation of Coarse Pulverized Product

A twin-screw kneading extruder was used to knead 15 parts by weight of the colorant master batch and 85 parts by weight of the polyester resin. The kneaded product extruded from the extrusion port of the twin-screw kneading extruder was then cooled. The obtained kneaded product was pulverized in a hammer mill to obtain a coarse pulverized product.

Wet Pulverization Step

The coarse pulverized product obtained by the method described above, an acrylic-modified silicone (FA40021D, manufactured by Toray Dow Corning), aminopropyl phenyl trimethycone (2-2078 Fluid, manufactured by Toray Dow Corning), a silanol-containing polysiloxane (DC593, manufactured by Toray Dow Corning), and dimethyl silicone oil (KF-96, manufactured by Shin-Etsu Chemical Co., Ltd.; 50 cs) as a liquid insulator were placed in a ceramic pot (internal volume: 600 mL), zirconia balls (ball diameter: 10 mm) were further placed in the ceramic pot to give a volume fill ratio of 40%, and wet pulverization was carried out in a tabletop pot mill for 48 hours at a rotation speed of 230 rpm. The average roundness $R_0$ of the particles included in the dispersion obtained by the present step was measured as 0.860 through use of an FPIA-3000S.

Heating Step

The dispersion obtained by the wet pulverization step was transferred to a beaker which was placed on a hot stirrer and heated to 60° C. A shear of 500 rpm was applied at this time, and heat treatment was carried out for 30 minutes. The dispersion was then allowed to cool to room temperature to obtain a liquid developer. The average roundness $R_1$ of the particles included in the obtained liquid developer was 0.912.

Comparative Example C1

A liquid developer was manufactured in the same manner as in Example C1 except that the acrylic-modified silicone was not used in the wet pulverization step, and the amounts of each component shown in Table 5 were used.

Comparative Example C2

A liquid developer was manufactured in the same manner as in Example C1 except that dimethyl silicone oil having a viscosity of 2 cs at 20° C. was used as the liquid insulator.

Comparative Example C3

A liquid developer was manufactured in the same manner as in Example C1 except that the heating step was omitted.

The compositions and manufacturing conditions for the liquid developers of each example and comparative example are summarized in Table 5. Roundness in each example and comparative example was measured as described below. Specifically, for each example and comparative example, a diluted solution was obtained by adding silicone oil (viscosity: 2 cs) to the obtained dispersion and liquid developer to obtain a dilution factor of 1,000 based on volume, and performing ultrasonic dispersion for one minute. Roundness was measured for the resultant diluted solution through use of an FPIA-3000S flow-type particle size distribution analyzer (manufactured by Sysmex). In the table, the polyester resin (glass transition temperature: 55° C.) is indicated as PES1, the polyester resin (glass transition temperature: 60° C.) as PES2, the acrylic-modified silicone (FA40021D, manufactured by Toray Dow Corning) as A1, the acrylic-modified silicone (FA4001CM, cyclopentasiloxane solution, manufactured by Toray Dow Corning) as A2, the dimethyl silicone oil (KF-96, manufactured by Shin-Etsu Chemical Co., Ltd.) as KF96, and the dimethyl silicone oil (KF-96-50cs, manufactured by Shin-Etsu Chemical Co., Ltd.) as KF-96-50cs. Also, the abovementioned acrylic-modified silicones were both insoluble in the dimethyl silicone oil on the basis of the standard described above.

TABLE 5

| | Composition of liquid developer | | | | | | | | | | | | | | |
|---|---|---|---|---|---|---|---|---|---|---|---|---|---|---|---|
| | Toner particles | | | | | | Acrylic-modified silicone | | Aminopropyl phenyl trimethycone | Silanol-containing polysiloxane | Heat treatment conditions | | | | |
| | Resin material | | | Colorant | Liquid insulator | | | | | | | | | | |
| | Type | Content (parts by weight) | Tg (° C.) | Content (parts by weight) | Type | Content (parts by weight) | Type | Content (parts by weight) | Content (parts by weight) | Content (parts by weight) | Heating temperature (° C.) | Heating time (minutes) | Speed (rmp) | $R_0$ | $R_1$ |
| Example C1 | PES1 | 20 | 55 | 15 | KF-96 (50 cst) | 74.1 | A1 | 3 | 0.4 | 2.5 | 60 | 30 | 500 | 0.860 | 0.905 |
| Example C2 | PES1 | 20 | 55 | 15 | KF-96 (50 cst) | 72.1 | A1 | 5 | 0.4 | 2.5 | 60 | 30 | 500 | 0.860 | 0.908 |
| Example C3 | PES1 | 20 | 55 | 15 | KF-96 (50 cst) | 70.1 | A1 | 7 | 0.4 | 2.5 | 60 | 30 | 500 | 0.865 | 0.909 |
| Example C4 | PES1 | 20 | 55 | 15 | KF-96 (50 cst) | 67.1 | A1 | 10 | 0.4 | 2.5 | 60 | 30 | 500 | 0.862 | 0.908 |
| Example C5 | PES1 | 20 | 55 | 15 | KF-96 (50 cst) | 76.1 | A1 | 0.5 | 0.4 | 2.5 | 60 | 30 | 500 | 0.857 | 0.901 |
| Example C6 | PES1 | 20 | 55 | 15 | KF-96 (50 cst) | 74.1 | A2 | 3 | 0.4 | 2.5 | 60 | 30 | 500 | 0.854 | 0.902 |

TABLE 5-continued

| | Composition of liquid developer | | | | | | | | | | | | | | |
|---|---|---|---|---|---|---|---|---|---|---|---|---|---|---|---|
| | Toner particles | | | | | | Acrylic-modified silicone | | Amino-propyl phenyl tri-methycone | Silanol-containing poly-siloxane | Heat treatment conditions | | | | |
| | Resin material | | | Colorant | Liquid insulator | | | | | | | | | | |
| | Type | Content (parts by weight) | Tg (° C.) | Content (parts by weight) | Type | Content (parts by weight) | Type | Content (parts by weight) | Content (parts by weight) | Content (parts by weight) | Heating temperature (° C.) | Heating time (minutes) | Speed (rmp) | $R_0$ | $R_1$ |
| Example C7 | PES2 | 20 | 60 | 15 | KF-96 (50 cst) | 74.1 | A1 | 3 | 0.4 | 2.5 | 65 | 30 | 500 | 0.850 | 0.900 |
| Example C8 | PES1 | 20 | 55 | 15 | KF-96 (50 cst) | 74.1 | A1 | 3 | 0.4 | 2.5 | 60 | 30 | 500 | 0.860 | 0.912 |
| Comparative Example C1 | PES1 | 20 | 55 | 15 | KF-96 (50 cst) | 77.1 | — | — | 0.4 | 2.5 | 60 | 30 | 500 | 0.839 | 0.920 |
| Comparative Example C2 | PES1 | 20 | 55 | 15 | KF-96L (2 cst) | 74.1 | A1 | 3 | 0.4 | 2.5 | 60 | 30 | 500 | 0.851 | 0.905 |
| Comparative Example C3 | PES1 | 20 | 55 | 15 | KF-96 (50 cst) | 74.1 | A1 | 3 | 0.4 | 2.5 | — | — | — | 0.855 | 0.855 |

[C2] Evaluation

The liquid developers obtained as described above were evaluated as described below.

[C2.1] Development Efficiency

Using an image formation device such as the one shown in FIGS. 1 and 2, a liquid developer layer of the liquid developer obtained in each example and comparative example was formed on a development roller of the image formation device. The surface potential of the development roller was then set to 300 V, the surface potential of a photoreceptor was uniformly charged to 500 V, the photoreceptor was exposed, and the charge on the photoreceptor surface was attenuated to obtain a surface potential of 50 V. After the liquid developer layer passed between the photoreceptor and the development roller, the toner particles on the development roller and the toner particles on the photoreceptor were collected using tape. Each tape used for collection was affixed to a recording paper, and the concentration of each set of toner particles was measured. After measurement, the development efficiency was calculated by multiplying 100 by the number obtained by dividing the concentration of the toner particles collected from the photoreceptor by the sum of the concentration of the toner particles collected from the photoreceptor and the concentration of the toner particles collected from the development roller, and the development efficiency was evaluated according to the four levels shown below.

A: Development efficiency of 96% or higher; particularly excellent.

B: Development efficiency of 90% or higher but less than 96%; excellent.

C: Development efficiency of 80% or higher but less than 90%; no practical problems.

D: Development efficiency of less than 80%; inferior.

[C2.2] Transfer Efficiency

Using an image formation device such as the one shown in FIGS. 1 and 2, a liquid developer layer of the liquid developer obtained in each example and comparative example was formed on a photoreceptor of the image formation device. After the liquid developer layer passed between the photoreceptor and the intermediate transfer part, the toner particles on the photoreceptor and the toner particles on the intermediate transfer part were collected using tape. Each tape used for collection was affixed to a recording paper, and the concentration of each set of toner particles was measured. After measurement, the transfer efficiency was calculated by multiplying 100 by the number obtained by dividing the concentration of the toner particles collected from the intermediate transfer part by the sum of the concentration of the toner particles collected from the photoreceptor and the concentration of the toner particles collected from the intermediate transfer part, and the transfer efficiency was evaluated according to the four levels shown below.

A: Transfer efficiency of 96% or higher; particularly excellent.

B: Transfer efficiency of 90% or higher but less than 96%; excellent.

C: Transfer efficiency of 80% or higher but less than 90%; no practical problems.

D: Transfer efficiency of less than 80%; inferior.

[C2.3] Fixing Strength

Using an image formation device such as the one shown in FIGS. 1 and 2, an image of a predetermined pattern was formed on a recording paper (LPCPPA4 high-quality paper, manufactured by Seiko Epson) by the liquid developer obtained in each example and comparative example. Heat fixing was then performed at a set temperature of 100° C. After a non-offset region was confirmed, the fixed image on the recording paper was rubbed twice using a rubber eraser (Lion 261-11 sand texture eraser, manufactured by Lion Office Products Corp.) with a pressure load of 1.2 kgf, and the residual ratio of image density was measured using an X-Rite model 404 manufactured by X-Rite, Inc. and evaluated according to the five levels shown below.

A: Residual image density of 96% or higher (extremely good).

B: Residual image density of 90% or higher but less than 96% (good).

C: Residual image density of 80% or higher but less than 90% (normal).

D: Residual image density of 70% or higher but less than 80% (somewhat poor).

E: Residual image density of less than 70% (extremely poor).

[C2.4] Positive Charging Characteristics

The potential difference for the liquid developer obtained in each example and comparative example was measured using a ZC-2000 "microscope laser zeta potentiometer" manufactured by Microtec Nition Corporation, and evaluated according to the five levels shown below. In the measurement, the liquid developer was diluted with a dilution medium and placed in a 10 mm transparent cell, and by observing the movement speed of the particles in the cell under a microscope while applying a voltage of 300 V across electrodes 9 mm apart, the movement speed was computed, and the zeta potential was calculated from this value.

A: Potential difference of +100 mV or greater (extremely good).

B: Potential difference of +85 mV or greater but less than +100 mV (good).

C: Potential difference of 70 mV or greater but less than +85 mV (normal).

D: Potential difference of 50 mV or greater but less than +70 mV (somewhat poor).

E: Potential difference of less than +50 mV (extremely poor).

[C2.5] Dispersion Stability Test

[C2.5.1] Method 1

An amount of 10 mL of the liquid developer obtained in each example and comparative example was placed in a test tube (mouth diameter: 12 mm, length: 120 mm), the depth of precipitation was measured after standing for 10 days, and evaluation was made according to the four levels shown below.

A: Precipitated depth of 0 mm.

B: Precipitated depth greater than 0 mm, and 2 mm or less.

C: Precipitated depth greater than 2 mm, and 5 mm or less.

D: Precipitated depth greater than 5 mm.

[C2.5.2] Method 2

An amount of 45.5 mL of the liquid developer obtained in each example and comparative example was placed in a centrifuge tube, and after the tube was placed in a centrifuge (manufactured by Kokusan Co., Ltd.) for three minutes at speeds of 500, 1000, 2000, 4000, and 5000 rpm at a rotation radius of 5 cm, the precipitated depth for each speed was measured. The measured results were plotted with the centrifugal acceleration $r\omega^2$ ($r\omega^2$=1118×rotation radius (cm)×per-minute speed (rpm)$^2$×$10^{-8}$ g (gravitational acceleration)) on the horizontal axis and the precipitated depth on the vertical axis. The slope k was calculated by primary approximation based on each plot, and evaluation was made according to the criteria shown below. The lower the value of k, the higher the dispersion stability.

A: $0 \leq k < 0.004$

B: $0.004 \leq k < 0.008$

C: $0.008 \leq k < 0.012$

D: $k \geq 0.012$

[C2.6] Recyclability

An image of a predetermined pattern was formed on 10,000 sheets of recording paper (LPCPPA4 high-quality paper, manufactured by Seiko Epson) by an image formation device such as the one shown in FIGS. 1 and 2 using the liquid developer obtained in each example and comparative example. This image formation was performed in a state in which feeding of the liquid developer from the liquid developer tank of each color to the stirring device of each corresponding color was stopped. After images were formed on 10,000 sheets of recording paper, testing was performed by two types of methods (Method 1, Method 2) such as described below for the liquid developer (recycled liquid developer) regenerated by diluting the toner particles recovered by the stirring devices with the liquid insulator to give a solids content ratio of 20% by mass, and the adaptability (recycling properties) of recycling was evaluated.

[C2.6.1] Method 1

An amount of 10 mL of the recycled liquid developer for each example and comparative example was placed in a test tube (mouth diameter: 12 mm, length: 120 mm), the depth of precipitation was measured after standing for 10 days, and evaluation was made according to the four levels shown below.

A: Precipitated depth of 1 mm or less.

B: Precipitated depth greater than 1 mm, and 3 mm or less.

C: Precipitated depth greater than 3 mm, and 6 mm or less.

D: Precipitated depth greater than 6 mm.

[C2.6.2] Method 2

An amount of 45.5 mL of the recycled liquid developer obtained for each example and comparative example was placed in a centrifuge tube, and after the tube was placed in a centrifuge (manufactured by Kokusan Co., Ltd.) for five minutes at speeds of 500, 1000, 2000, 4000, and 5000 rpm at a rotation radius of 5 cm, the precipitated depth for each speed was measured. The measured results were plotted with the centrifugal acceleration $r\omega^2$ ($r\omega^2$=1118×rotation radius (cm)×per-minute speed (rpm)$^2$×$10^{-8}$ g (gravitational acceleration)) on the horizontal axis and the precipitated depth on the vertical axis. The slope k was calculated by primary approximation based on each plot, and evaluation was made according to the criteria shown below. The lower the value of k, the higher the dispersion stability.

A: $0 \leq k < 0.006$

B: $0.006 \leq k < 0.010$

C: $0.010 \leq k < 0.014$

D: $k \geq 0.014$

These results are shown in Table 6.

TABLE 6

| | Development efficiency | Transfer efficiency | Fixing strength | Positive charging characteristics | Dispersion stability | | Recyclability | |
|---|---|---|---|---|---|---|---|---|
| | | | | | Method 1 | Method 2 | Method 1 | Method 2 |
| Example C1 | A | A | A | A | A | A | A | A |
| Example C2 | A | A | A | A | A | A | A | A |
| Example C3 | A | A | A | A | A | A | A | A |
| Example C4 | B | B | A | A | A | A | A | A |
| Example C5 | B | B | A | B | A | A | A | A |
| Example C6 | A | A | A | A | A | A | A | A |

TABLE 6-continued

| | Development efficiency | Transfer efficiency | Fixing strength | Positive charging characteristics | Dispersion stability | | Recyclability | |
|---|---|---|---|---|---|---|---|---|
| | | | | | Method 1 | Method 2 | Method 1 | Method 2 |
| Example C7 | A | A | A | A | A | A | A | A |
| Example C8 | A | A | A | A | A | A | A | A |
| Comparative Example C1 | C | C | B | C | D | D | D | D |
| Comparative Example C2 | C | C | B | C | C | C | C | C |
| Comparative Example C3 | D | D | B | D | D | D | D | D |

As is apparent from Table 6, the liquid developer of the invention has excellent charging characteristics (positive charging characteristics). The liquid developer of the invention also has excellent recyclability and long-term dispersion stability of the toner particles. The liquid developer of the invention also has excellent development efficiency, transfer efficiency, and fixing strength. In contrast, satisfactory results were not obtained from the liquid developers of the comparative examples.

What is claimed is:

1. A liquid developer comprising:

a liquid insulator; and toner particles including a resin material, a colorant, a substance A, a substance B, and a substance C, the substance A being an acrylic-modified silicone;

the substance B being at least one selected from the group consisting a quaternary cationic silicone, an aminophenyl-modified silicone, and a phenyl-modified silicone, the substance C being at least one of a silanol-containing polysiloxane and a fluorine-modified silicone, an average degree of roundness $R_1$ of the toner particles is 0.890 or greater, the degree of roundness being equal to $L_0/L_1$, where $L_1$ (μm) is a circumference of a profile view, which has a size in area, of a measured particle and $L_0$ (μm) is the circumference of a profile view of a perfect circle which has the size in area.

2. A method for producing a liquid developer, the liquid developer including a liquid insulator, and toner particles including a resin material, a colorant, a substance A, a substance B, and a substance C, the substance A being an acrylic-modified silicone, the substance B being at least one selected from the group consisting a quaternary cationic silicone, an aminophenyl-modified silicone, and a phenyl-modified silicone, the substance C being at least one of a silanol-containing polysiloxane and a fluorine-modified silicone, the average degree of roundness $R_1$ of the toner particles is 0.890 or greater, if the degree of roundness is expressed as $L_0/L_1$, where $L_1$ (μm) is a circumference of a profile view of a measured particle and $L_0$ (μm) is the circumference of a perfect circle of a circumference of a profile view corresponding to the profile view of the measured particle, the method for producing the liquid developer comprising:

pulverizing a powder including a material which includes a resin material and a colorant in the presence of the substance A and the substance B to obtain a dispersion in the liquid insulator;

heat-treating the dispersion at a temperature higher than a glass transition temperature of the resin material while applying a shearing force to the dispersion; and mixing the dispersion to which the heat treatment has been applied and the substance C, the heat-treating being after the pulverizing and before the mixing.

3. The method for producing the liquid developer according to claim 2, wherein the pulverizing the powder is performed such that the average roundness $R_0$ of particles prior to the heat treatment is greater than or equal to 0.800 and less than or equal to 0.889.

4. The method for producing the liquid developer according to claims 2, wherein the substance A is used in the pulverizing such that a content ratio thereof in the liquid developer is 0.5% by mass or greater and 10.0% by mass or less.

5. The method for producing the liquid developer according to claim 2, wherein the substance B is used in the pulverizing such that a content ratio thereof in the liquid developer is 0.02% by mass or greater and 4.0% by mass or less.

6. The method for producing the liquid developer according to claims 2, wherein the substance C is used in the pulverizing such that a content ratio thereof in the liquid developer ultimately obtained is 0.02% by mass or greater and 12.5% by mass or less.

7. The method for producing the liquid developer according to claim 2, wherein the resin material is a polyester resin or a rosin-based resin.

8. A method for producing a liquid developer, the liquid developer including a liquid insulator, and toner particles including a resin material, a colorant, a substance A, a substance B, and a substance C, the substance A being an acrylic-modified silicone, the substance B being at least one selected from the group consisting a quaternary cationic silicone, an aminophenyl-modified silicone, and a phenyl-modified silicone, the substance C being at least one of a silanol-containing polysiloxane and a fluorine-modified silicone, the average degree of roundness $R_1$ of the toner particles is 0.890 or greater, if the degree of roundness is expressed as $L_0/L_1$, where $L_1$ (μm) is a circumference of a profile view of a measured particle and $L_0$ (μm) is the circumference of a perfect circle of a circumference of a profile view corresponding to the profile view of the measured particle, the method for producing the liquid developer, comprising:

pulverizing a powder including a material which includes a resin material and a colorant in the presence of the substance A, the substance B, and the substance C to obtain a dispersion in the liquid insulator; and heat-treating the dispersion at a temperature higher than a glass transition temperature of the resin material while applying a shearing force to the dispersion, the heat-treating being after the pulverizing.

9. A method for producing a liquid developer, comprising:

pulverizing a toner material which includes a polyester resin and a colorant in a liquid insulator having a viscosity of 20 cs or greater at 20° C. and in the presence of an acrylic-modified silicone that is essentially insoluble in the liquid insulator, and a solvent in which the acrylic-modified silicone is insoluble, where the solvent is soluble in the liquid insulator, to obtain a dispersion in which microparticles are dispersed; and obtaining a liquid developer in which toner particles are dispersed in the liquid insulator, by heat-treating the dispersion at a temperature higher than a glass transition temperature of the polyester resin while applying a shearing force to the dispersion; and mixing the liquid developer after the heat-treating.

10. The method for producing a liquid developer according to claim 9, wherein the acrylic-modified silicone is used in the pulverizing such that a content ratio thereof in the liquid developer is 0.5% by mass or greater and 10.0% by mass or less.

11. The method for producing the liquid developer according to claim 9, wherein the pulverizing is performed such that the average roundness $R_0$ of particles prior to the heat treatment is greater than or equal to 0.800 less than or equal to 0.889.

12. The method for producing the liquid developer according to claim 9, wherein the toner material is a coarse pulverized product obtained by coarsely pulverizing a kneaded product which includes the polyester resin and the colorant.

13. The method for producing the liquid developer according to claim 9, wherein the solvent is at least one of a volatile aliphatic hydrocarbon and a volatile silicone oil.

14. The method for producing the liquid developer according to claim 9, wherein a dispersant is included in the liquid insulator in the mixing.

15. The method for producing the liquid developer according to claim 14, wherein the dispersant is a silicone resin.

16. The method for producing the liquid developer according to claim 9, wherein the liquid insulator includes silicone oil.

* * * * *